United States Patent [19]

Ishikawa

[11] Patent Number: 5,063,142

[45] Date of Patent: Nov. 5, 1991

[54] PROCESS FOR PROCESSING SILVER HALIDE COLOR PHOTOGRAPHIC MATERIALS

[75] Inventor: Takatoshi Ishikawa, Ashigara, Japan

[73] Assignee: Fuji Photo Film Co., Ltd., Kanagawa, Japan

[21] Appl. No.: 525,818

[22] Filed: May 21, 1990

[30] Foreign Application Priority Data

May 22, 1989 [JP] Japan ..... 1-128388

[51] Int. Cl.[5] ..... G03C 7/42

[52] U.S. Cl. ..... 430/400; 430/376; 430/388; 430/389; 430/393; 430/460; 430/543; 430/558; 430/963

[58] Field of Search ..... 430/376, 388, 389, 393, 430/400, 460, 543, 558, 567, 963

[56] References Cited

U.S. PATENT DOCUMENTS

| | | | |
|---|---|---|---|
| 3,700,450 | 10/1972 | Cooley | 430/400 |
| 3,907,568 | 9/1975 | Shirasu et al. | 430/393 |
| 4,128,464 | 12/1978 | Idota | 430/400 |
| 4,766,057 | 8/1988 | Sakai | 430/567 |
| 4,892,807 | 1/1990 | Hirabayashi et al. | 430/567 |

*Primary Examiner*—Hoa Van Le

*Attorney, Agent, or Firm*—Sughrue, Mion, Zinn, Macpeak & Seas

[57] ABSTRACT

A process for processing a silver halide color photographic material is disclosed, which comprises color developing and bleach-fixing the silver halide color photographic material, and then processing by at least one of washing the material with water and stabilizing the material, the silver halide color photographic material comprising a support having thereon at least one emulsion layer comprising a high silver chloride emulsion having a silver chloride content of 80 mol % or more and a used bleach-fixing solution which has been already used for the bleach-fixing, having a silver ion concentration of 0.02 mol/liter or more being used as a bleach-fixing solution for replenishment. In one embodiment, the silver halide color photographic material contains at least one yellow coupler represented by formula (I):

(I)

wherein X represents a substituent, and Y represents a releasing group represented by wherein Z represents a heterocyclic ring, and m represents an integer of 1 to 5, wherein the silver halide is coated at a silver amount of 0.4 to 0.8 g/m$^2$ of the silver halide photographic material.

10 Claims, No Drawings

PROCESS FOR PROCESSING SILVER HALIDE COLOR PHOTOGRAPHIC MATERIALS

FIELD OF THE INVENTION

The present invention relates to a process for processing a silver halide color photographic material and, more particularly, to a process for processing which reduces the amount of waste liquor and decreases running cost by reusing a used bleach-fixing solution in continuous processing.

BACKGROUND OF THE INVENTION

In processing silver halide color photographic materials, used processing solutions are generally discharged as an overflow solution However, since such overflow solution still contains active ingredients, many studies have been conducted on so-called regeneration techniques of utilizing the overflow solution as a replenisher by adding thereto deficient ingredients. Reuse of the overflow solution as a replenisher is preferable not only because running cost is decreased since amounts of chemicals to be used can be decreased in comparison with the case of newly prepared replenishers but because environmental pollution is markedly reduced since the amount of overflow waste is decreased, thus being preferable in view of preservation of the environment, too.

However, it is difficult to develop the technique of regenerating the overflow solution, and regeneration of a bleach-fixing solution has been believed to be particularly difficult. A bleach-fixing solution generally contains at least three chemicals having different functions, i.e., an iron aminopolycarboxylate (III) complex as a bleaching agent, a thiosulfate as a fixing agent, and a sulfite as a preservative. An overflow solution of the bleach-fixing solution further contains silver ions and color developer ingredients brought over from a prebath. In addition, it contains iron aminopolycarboxylate (II). In reusing this solution, there arises delayed desilvering, conversion of a cyan dye to its leuco form (color restoration failure) or undesirable stain (stain or background) due to accumulation of halide ions or silver ions, accumulation of iron aminopolycarboxylate (II), and accumulation of developer ingredients or accumulation of a sulfate produced as a result of the oxidation of the sulfite ion.

In order to solve the above-described problems, various regeneration techniques have been proposed. A technique of bringing a used solution into contact with metallic iron (steel wool) is disclosed, for example, in *Radiography*, 29, 256–259 (1963), and JP-A-48-2624 (the term "JP-A" as used herein refers to a "published unexamined Japanese patent application"). In accordance with this technique, the silver ion concentration can be decreased by recovering metallic silver formed by the contact between silver ions and metallic iron, but the oxidizing power of the bleach-fixing solution is reduced since the metallic iron dissolves out as an iron (II) ion having a strong reducing ability, thus desilvering failure or color restoration failure is likely to occur. The possibility of this problem arising increases as the silver ion concentration decreases.

A technique of recovering silver ions by reducing it through electrolysis is described, for example, in JP-A-50-98837, JP-A-51-19535, JP-A-51-36136, and U.S. Pat. No. 4,014,764. In this technique, too, an iron (III) complex is concurrently reduced to an iron (II) complex, or a sulfite ion around a cathode is oxidized to a sulfate ion, thus desilvering failure or color restoration failure is also likely to occur and, at the same time, solution stability is decreased. The above described problems become more serious as the amount of electric current is increased to decrease the iron ion concentration in the bleach-fixing solution by increasing the yield of silver recovery.

A technique of removing the silver complex by adsorbing it with an ion exchange resin is described, for example, in *J. Appl. Photogr. Eng.* 6, 14-18 (1980), SMPTE J, 93, 800–807 (1984). However, this technique requires the liberation of the adsorbed iron complex from the resin for regeneration of the resin. Hence, procedures for effecting the technique are complicated, and a large amount of waste liquor is produced. Thus, this technique is not satisfactory in view of running cost.

JP-A-48-49437 and JP-A-50-145231 disclose a technique of regenerating the overflow solution by decreasing the equilibrium accumulation amount of silver ion through dilution or the like without positively removing silver. This technique is simple and less costly because no special desilvering apparatuses are required. In this technique, however, the accumulation of silver halide dissolved from the light-sensitive material, particularly dissolved silver bromide is present in a large amount, and the accumulation of sulfate delays desilvering. In addition, the accumulation of developer ingredients causes undesired stain and tends to cause color restoration failure. Thus, this technique involves problems as to the stability of running properties.

SUMMARY OF THE INVENTION

An object of the present invention is to provide a process for regenerating a used bleach-fixing solution which solves the problem of desilvering failure due to the accumulation of silver ions or sulfate radicals and, at the same time, prevents stain or color restoration failure.

The inventors have found that the above described object can be attained by a process for processing a silver halide color photographic material, which comprises color developing and bleach-fixing the silver halide color photographic material, and then processing by at least one of washing the material with water and stabilizing the material, the silver halide color photographic material comprising a support having thereon at least one emulsion layer comprising a silver chloride-rich emulsion having a silver chloride content of 80 mol % or more and a used bleach-fixing solution which has been already used for said bleach-fixing solution, i.e., an overflow bleach-fixing solution, having a silver ion concentration of 0.02 mol/liter or more being used as a bleach-fixing solution for replenishment.

The above described object can be more effectively attained by a process for processing a silver halide color photographic material, wherein the silver halide color photographic material contains at least one yellow coupler represented by formula (I):

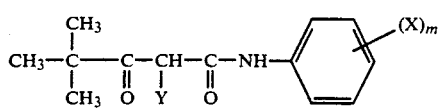

(I)

wherein X represents a substituent, Y represents a releasing group represented by

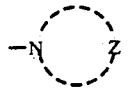

wherein Z represents a heterocyclic ring, and m represents an integer of 1 to 5.

DETAILED DESCRIPTION OF THE INVENTION

The silver ion concentration of the bleach-fixing solution for replenishment of the present invention being 0.02 mol/liter or more means that, even when the silver ion concentration dissolved into an overflow solution is increased as a result of continuous processing, the silver ion is not removed from the overflow solution or desilvering is conducted to such a degree that the silver ion concentration does not become less than 0.02 mol/liter. When the silver ion is positively removed as is conventionally done to decrease the silver ion concentration to as low as about 0.01 mol/liter or less, there arise the following problems. That is, in the electrolytic technique, desilvering failure or conversion of cyan dye to a leuco form thereof is likely to occur due to the production of iron (II) complex or the accumulation of sulfate ions. In the case of using metallic iron, an iron (II) complex is formed in such a large amount that the oxidation power of the bleach-fixing solution is decreased, thus desilvering failure is likely to occur. Therefore, in the present invention, a technique of regenerating a bleach-fixing solution without extremely decreasing silver ion concentration is used. A mere increase in the amount of accumulated silver ion leads to a decrease in the desilvering rate as described in JP-A-50-145231. In the present invention, however, it has been found that the above described problem can be solved by using a silver chloride-rich emulsion (i.e., high silver chloride emulsion) as the silver halide emulsion. That is, the present invention is based on the discovery that the accumulation of silver ions is largely influenced by a halide ion which is a counter ion of a silver ion and that the accumulation of silver iodide or a large amount of silver bromide seriously decreases the initial desilvering rate whereas the accumulation of a large amount of silver chloride scarcely influences the desilvering properties of a silver chloride emulsion. With a silver chloride-rich emulsion (i.e., a high silver chloride emulsion) containing a slight amount of silver bromide, slight dissolution of the silver bromide scarcely influences the desilvering properties of the emulsion.

As is described above, the present invention enables continuous processing without substantial removal of silver ion while not preventing desilvering properties contrary to the conventional knowledge that silver ions present in a dissolved state must be removed as much as possible, which is quite unexpected.

In the present invention, the amount of accumulated silver ion is generally 0.02 mol/liter or more, preferably 0.02 to 0.4 mol/liter, more preferably 0.04 to 0.3 mol/liter. If the amount of accumulated silver ion is too much, desilvering failure is easily generated, thus such excess amounts are not preferable.

In the case of conducting bleach-fixing processing immediately after color development, a light-sensitive material using a silver chloride-rich emulsion in each emulsion layer sometimes suffers processing unevenness due to incomplete stopping of development with a bleach-fixing solution resulting from a too rapid color developing rate as is described in International Laid-Open No. WO 87/04534. Such unevenness is easily generated when processing is conducted in a roller transporting automatic developing machine in which the transporting time between color development and bleach-fixing (light-sensitive material transporting time) is longer. It is worthy of special mention that the above described processing unevenness can be removed by processing with a bleach-fixing solution having a comparatively high silver ion concentration as in the present invention.

In the process of the present invention for regenerating a used bleach-fixing solution (i.e., overflow solution), it is preferable not to remove silver ions from the overflow solution or to dilute it with water only to such a degree that the silver ion concentration does not become less than 0.02 mol/liter and add only deficient ingredients, i.e., regenerating agents (for example, a bleaching agent, a fixing agent and a preservative) for reusing the overflow solution as a bleach-fixing solution for replenishment. Various processes for recovering silver may be employed in combination with the process of the present invention. For example, silver ions may be properly removed under mild conditions according to the process of electrically recovering silver (process of electrolytically recovering silver) described in JP-A-51-19535, JP-A-48-18191, JP-A-51-19535 and JP-A-51-36136 or the process of recovering silver by bringing the silver ions into contact with metallic iron as described in JP-A-48-3624, and regenerating ingredients may be added thereto to prepare a bleach-fixing solution for replenishment (i.e., a replenishing bleach-fixing solution).

The kinds and amounts of the ingredients to be added to the used bleach-fixing solution may be easily decided by previously selecting kinds and amounts thereof capable of providing satisfactory photographic properties.

The bleach-fixing solution to be used in the present invention is described in detail below.

As the oxidizing agent to be used in the bleach-fixing solution of the present invention, an iron (III) aminopolycarboxylate complex is preferably used. The aminopolycarboxylic acid for the iron (III) aminopolycarboxylate complex includes ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, and glycol ether diaminetetraacetic acid.

These compounds may be in the form of a sodium salt, a potassium salt, a lithium salt or an ammonium salt. Of these compounds, iron (III) complex salts of ethylenediaminetetraacetic acid, diethylenetriaminepentaacetic acid, cyclohexanediaminetetraacetic acid, 1,3-diaminopropanetetraacetic acid and methyliminodiacetic acid are preferable because of their higher bleaching ability.

These ferric ion complex salts may be used in the form of complex salts or may be formed in situ in the solution using a ferric salt such as ferric sulfate, ferric chloride, ferric nitrate, ferric ammonium sulfate or ferric phosphate and a chelating agent such as an aminopolycarboxylic acid. The chelating agent may be used in an excess amount of more than is necessary for forming the ferric ion complex salt. Of the iron complexes, iron aminopolycarboxylate complexes are preferable, and are added in amounts of generally 0.01 to 1.0 mol/liter, preferably 0.05 to 0.50 mol/liter. In the bleach-fixing solution of the present invention, various compounds may be used as bleaching accelerators. For example, mercapto group- or disulfido bond-containing compounds described in U.S. Pat. No. 3,893,858, West German Patent 1,290,812, JP-A-53-95630, and *Research Disclosure,* No. 17129 (July, 1978) and thiourea compounds described in JP-B-45-8506 (the term "JP-B" as used herein refers to an "examined Japanese patent publication"), JP-A-52-20832, JP-A-53-32735 and U.S. Pat. No. 3,706,561 are preferable in view of the fact that they have an excellent bleaching ability.

Fixing agents to be used in the bleach-fixing solution in accordance with the present invention are known fixing agents, i.e., water-soluble silver halide-dissolving agents such as thiosulfates (e.g., sodium thiosulfate and ammonium thiosulfate), thiocyanates (e.g., sodium thiocyanate and ammonium thiocyanate), thioether compounds (e.g., ethylenebisthioglycolic acid and 3,6-dithio-1,8-octanediol), and thioureas. These may be used alone or in a combination of two or more. In the present invention, use of thiosulfates is preferable, with ammonium thiosulfate being particularly preferred. The amount of fixing agent per liter is preferably from 0.3 to 2 mols, more preferably from 0.5 to 1.0 mol.

The bleach-fixing solution or the fixing solution contains as a preservative a compound capable of releasing a sulfite ion such as a sulfite (e.g., sodium sulfite, potassium sulfite or ammonium sulfite), a bisulfite (e.g., ammonium bisulfite, sodium bisulfite or potassium bisulfite), or a metabisulfite (e.g., potassium metabisulfite, sodium metabisulfite or ammonium metabisulfite). These compounds are incorporated in amounts of preferably about 0.02 to about 0.50 mol/liter (in terms of sulfite ion), more preferably 0.04 to 0.40 mol/liter.

It is preferable to use as a preservative a carbonyl-bisulfite adduct for the purpose of reducing the substantial concentration of sulfite ion and preventing an increase of sulfate ion resulting from regeneration. Preferable carbonyl compounds include acetaldehyde, acetone, nicotinic aldehyde and benzaldehyde. These compounds may be added to a bleach-fixing solution separately from the sulfite or may be added in the form of an adduct.

The bleach-fixing solution to be used in the present invention has a pH of generally 4 to 7, preferably 5 to 6.75, in a processing tank. If the pH is higher than the upper limit, there can result desilvering failure, stain or uneven processing, whereas if lower than the lower limit, there can result color restoration failure or stain due to deterioration of the solution. Bleach-fixing time is preferably 10 to 60 seconds, more preferably 20 to 50 seconds, from the point of view of fully obtaining the advantages of the present invention. If the bleach-fixing time is longer than the longer limit, there results insufficient advantages of the present invention with respect to desilvering property and color restoration, whereas a time shorter than the shorter limit, there can result desilvering failure.

In preparing the replenishing bleach-fixing solution in accordance with the present invention, deficient chemicals can be added to the overflow solution as regenerating agents. Such deficient chemicals include the aforementioned bleaching agent, fixing agent, preservative, etc.

These compounds are added preferably in the ammonium salt form for the purpose of preventing the reduction of desilvering property. Specific examples thereof include iron (III) ammonium ethylenediaminetetraacetate, ammonium sulfite, ammonium bisulfite and ammonium thiosulfate. In addition, various organic or inorganic acids may be added for the purpose of decreasing the pH of the solution. Preferable acids include acetic acid, nitric acid, citric acid, and hydrochloric acid.

In the course of regeneration, aeration or the addition of an oxidant (e.g., $H_2O_2$ or persulfate) may be conducted, if desired, for improving the oxidizing power of the bleach-fixing solution.

The color developer to be used in the present invention is now described in detail below.

The color developer to be used in the present invention contains a p-phenylenediamine color developing agent. Typical examples thereof are illustrated below which, however, are not limitative at all.

D- 1 N,N-Diethyl-p-phenylenediamine
D- 2 2-Amino-5-diethylaminotoluene
D- 3 2-Amino-5-(N-ethyl-N-laurylamino)toluene
D- 4 4-[N-Ethyl-N-(β-hydroxyethyl)amino]aniline
D- 5 2-Methyl-4-[N-ethyl-N-(β-hydroxyethyl-)amino]aniline
D- 6 4-Amino-3-methyl-N-ethyl-N-[β-(methanesulfonamido)ethyl]aniline
D- 7 N-(2-Amino-5-diethylaminophenylethyl)methanesulfonamide
D- 8 N,N-Dimethyl-p-phenylenediamine
D- 9 4-Amino-3-methyl-N-ethyl-N-methoxyethylaniline
D-10 4-Amino-3-methyl-N-ethyl-N-β-ethoxyethylaniline
D-11 4-Amino-3-methyl-N-ethyl-N-β-butoxyethyl-aniline Among these, D-4, D-5 and D-6 are preferred.

These p-phenylenediamine derivatives may be in the form of salts such as sulfates, hydrochlorides, sulfites and p-toluenesulfonates. The aromatic primary amine developing agents are used in amounts of preferably from about 0.1 g to about 20 g, more preferably from about 0.5 g to about 10 g, per liter of the developer.

The color developer to be used in the present invention preferably does not substantially contain sulfurous acids or a hydroxylamine salt conventionally used as a preservative. These compounds, when brought into a postbath of the bleach-fixing solution, reduce an oxidant of iron (III) aminopolycarboxylate complex to decrease its oxidizing power. These compounds exhibit this effect more markedly in the case of using a regenerated bleach-fixing solution and, therefore, can adversely affect desilvering property or color restoration. The term "not substantially contain" means that concentration of the compound is not more than $2.0\times10^{-3}$ mol/liter.

In order to solve the above described problem, it is preferable to use a hydroxylamine derivative or a hydrazine derivative represented by formula (II) or (III) in place of the hydroxylamine salt.

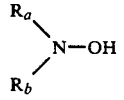

(II)

wherein $R_a$ and $R_b$, which may be the same or different, each represents a hydrogen atom or an alkyl group, with the proviso that $R_a$ and $R_b$ do not represent a hydrogen atom at the same time.

The alkyl group contains 1 to 6, preferably 1 to 3, carbon atoms, and preferable substituents therefor include a hydroxy group, an alkoxy group, a carbonic acid group, a sulfonic acid group and a phosphonic acid group. Preferable specific examples thereof are illustrated below.

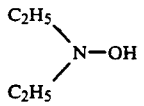
II-1

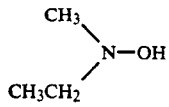
II-2

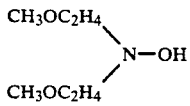
II-3

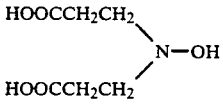
II-4

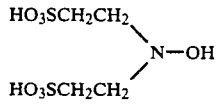
II-5

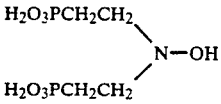
II-6

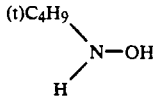
II-7

Among these, II-1, II-4 and II-5 are preferred. These compounds may be in salt form with various acids or with alkali metals or alkaline earth metals. They are added in amounts of 0.2 g to 50 g, preferably 1.0 g to 10 g, per liter of the color developer.

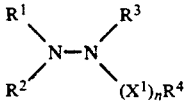
(III)

wherein $R^1$, $R^2$ and $R^3$ each independently represents a hydrogen atom, an alkyl group, an aryl group or a heterocyclic group, $R^4$ represents a hydrogen atom, a hydroxy group, a hydrazino group, an alkyl group, an aryl group, a heterocyclic group, an alkoxy group, an aryloxy group, a carbamoyl group or an amino group, $X^1$ represents a divalent group, and n represents 0 or 1, with the proviso that, when n=0, $R^4$ represents an alkyl group, an aryl group or a heterocyclic group, and $R^3$ and $R^4$ may be taken together to form a hetero ring.

The compounds represented by formula (III) to be used in the present invention, i.e., hydrazine analogs composed of hydrazines and hydrazides will be described in detail below.

$R^1$, $R^2$ and $R^3$ each independently represents a hydrogen atom, a substituted or unsubstituted alkyl group (containing preferably 1 to 20 carbon atoms, e.g., methyl, ethyl, sulfopropyl, carboxybutyl, hydroxyethyl, cyclohexyl, benzyl or phenethyl), a substituted or unsubstituted aryl group (containing preferably 6 to 20 carbon atoms, e.g., phenyl, 2,5-dimethoxyphenyl, 4-hydroxyphenyl or 2-carboxyphenyl) or a substituted or unsubstituted heterocyclic group (containing preferably 1 to 20 carbon atoms, being preferably a 5- or 6-membered ring, and containing at least one of oxygen, nitrogen, sulfur, etc., as a hetero atom; e.g., pyridin-4-yl or N-acetylpiperidin-4-yl).

$R^4$ represents a hydrogen atom, a hydroxy group, a substituted or unsubstituted hydrazino group (e.g., hydrazino, methylhydrazino or phenylhydrazino), a substituted or unsubstituted alkyl group (containing preferably 1 to 20 carbon atoms, e.g., methyl, ethyl, sulfopropyl, carboxybutyl, hydroxyethyl, cyclohexyl, benzyl, t-butyl or n-octyl), a substituted or unsubstituted aryl group (containing preferably 6 to 20 carbon atoms, e.g., phenyl, 2,5-dimethoxyphenyl, 4-hydroxyphenyl, 2-carboxyphenyl or 4-sulfophenyl), a substituted or unsubstituted heterocyclic group (containing preferably 1 to 20 carbon atoms, being preferably 5- or 6-membered ring, and containing at least one of oxygen, nitrogen, sulfur, etc., as a hetero atom; e.g., pyridin-4-yl or imidazolyl), a substituted or unsubstituted alkoxy group (containing preferably 1 to 20 carbon atoms, e.g., methoxy, ethoxy, methoxyethoxy, benzyloxy, cyclohexyloxy or octyloxy), a substituted or unsubstituted aryloxy group (containing preferably 6 to 20 carbon atoms, e.g., phenoxy, p-methoxyphenoxy, p-carboxyphenoxy or p-sulfophenoxy), a substituted or unsubstituted carbamoyl group (containing preferably 1 to 20 carbon atoms, e.g., unsubstituted carbamoyl, N,N-diethylcarbamoyl or phenylcarbamoyl), or a substituted or unsubstituted amino group (containing preferably 0 to 20 carbon atoms, e.g., amino, hydroxyamino, methylamino, hexylamino, methoxyethylamino, carboxyethylamino, sulfoethylamino, N-phenylamino or p-sulfophenylamino).

Further substituents for $R^1$, $R^2$, $R^3$ and $R^4$ are preferably a halogen atom (e.g., chlorine or bromine), a hydroxy group, a carboxy group, a sulfo group, an amino group, an alkoxy group, an amide group, a sulfonamide group, a carbamoyl group, a sulfamoyl group, an alkyl group, an aryl group, an aryloxy group, an alkylthio group, an arylthio group, a nitro group, a cyano group, a sulfonyl group, a sulfinyl group, etc., which may further be substituted.

$X^1$ is preferably a divalent organic residue and specifically represents, for example, $$-CO-,\ -SO_2-\ \text{or}\ -\overset{\overset{\displaystyle NH}{\|}}{C}-.$$

n represents 0 or 1, provided that, when n is 0, $R^4$ represents a group selected from substituted or unsubstituted alkyl, aryl and heterocyclic groups. $R^1$ and $R^2$, or $R^3$ and $R^4$, may be taken together to form a heterocyclic group.

When n is 0, at least one of $R^1$ to $R^4$ preferably represents a substituted or unsubstituted alkyl group. In particular, those wherein $R^1$, $R^2$, $R^3$ and $R^4$ each represents a hydrogen atom or a substituted or unsubstituted alkyl group are preferable (provided that $R^1$, $R^2$, $R^3$ and $R^4$ do not represent a hydrogen at the same time). Above all, those wherein $R^1$, $R^2$ and $R^3$ represent a hydrogen atom, and $R^4$ represents a substituted or unsubstituted alkyl group, those wherein $R^1$ and $R^3$ each represents a hydrogen atom, and $R^2$ and $R^4$ each represents a substituted or unsubstituted alkyl group, and those wherein $R^1$ and $R^2$ each represents a hydrogen atom, and $R^3$ and $R^4$ each represents a substituted or unsubstituted alkyl group ($R^3$ and $R^4$ optionally taken together to form a heterocyclic ring) are particularly preferable.

When n is 1, $X^1$ preferably represents —CO—, and $R^4$ preferably represents a substituted or unsubstituted amino group, and $R^1$ to $R^3$ each preferably represents a substituted or unsubstituted alkyl group.

The alkyl group represented by $R^1$ to $R^4$ contains preferably 1 to 10 carbon atoms, more preferably 1 to 7 carbon atoms. Preferred substituents for the alkyl group include a hydroxyl group, a carboxylic acid group, a sulfo group and a phosphonic acid group. Where two or more substituents exist, they may be the same or different from each other.

The compounds of the general formula (III) may form bis derivatives, tris derivatives or polymers bound through $R^1$, $R^2$, $R^3$ or $R^4$.

Specific examples of the compounds represented by the general formula (III) are illustrated below which, however, do not limit the present invention in any way.

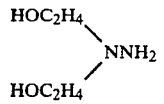
III-1

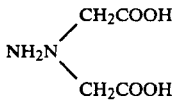
III-2

$HOOCCH_2NHNHCH_2COOH$ III-3

$H_2NNHCH_2CH_2CH_2SO_3H$ III-4

$H_2NNHCH_2CH_2SO_3H$ (III-5)

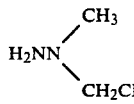
III-6

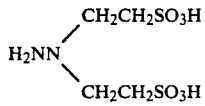
III-7

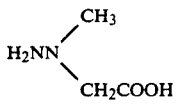
III-8

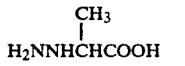
III-9

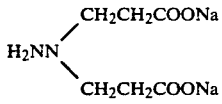
III-10

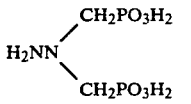
III-11

Specific examples other than those described above are described in European Patent Application 254280A, pages 11 to 24, Japanese Patent Application No. 61-171682, pages 12 to 22, Japanese Patent Application No. 61-173468, pages 9 to 19, and the like.

Many of the compounds represented by formula (III) are commercially available, and may be synthesized according to general processes described in *Organic Synthesis,* Coll. Vol. 2, pages 208 to 213; *Jour. Amer. Chem. Soc.,* 36, 1747 (1914); *Yukagaku* (*Oil Chemistry*), 24, 31 (1975); *Jour. Org. Chem.,* 25, 44 (1960); *Yakuhin Zasshi* (*Journal of Chemicals*), 91, 1127 (1971); *Organic Synthesis,* Coll. Vol. 1, page 450; *Shin Jikken Kagaku Koza* (*New Lecture on Experimental Chemistry,* Vol. 14, III, pages 1621 to 1628 (Maruzen); Beil., 2, 559; Beil., 3, 117; E. B. Mohr et al., *Inorg. Syn.,* 4, 32 (1953); F. J. Wilson and E. C. Pickering, *J. Chem. Soc.,* 123, 394 (1923); N. J. Leonard & T. H. Boyer, *J. Org. Chem.,* 15, 42 (1950); *Organic Synthesis,* Coll. Vol. 5, page 1055; P. A. S. Smith, *Derivatives of Hydrazine and Other Hydronitrogens Having N-N Bonds,* pages 120 to 124 and 130 to 131 (THE BENJAMIN/CUMMINGS PUBLISHING COMPANY, 1983); Stanley R. Sandier Waif Karo, *Organic Functional Group Preparations,* Vol. 1, Second Edition, page 457, etc.

The hydrazines or hydrazides represented by formula (III) are incorporated in the color developer in amounts of preferably 0.01 to 50 g, more preferably 0.1 to 30 g, most preferably 0.5 to 10 g, per liter of the color developer to use.

In addition, various preservatives may be used in the present invention. Preferable preservatives include triethanolamine, diethanolamine, catechol-3,5-disulfonate and catechol-3,4,5-trisulfonate.

The color developer to be used in the present invention has a pH of preferably 9 to 12, more preferably 9 to 11.0, and may further contain known developer ingredients.

In order to keep the pH at level described above, various buffer agents are preferably used. As such buffer agents, carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, lysine salts, etc., may be used. Of these, carbonates, phosphates, tetraborates and hydroxybenzoates are preferably used since they have the advantages that they have good dissolving properties and an excellent buffering ability in a high pH region of 9.0 or above, that they do not adversely affect photographic properties (such as fogging) when added to a color developer, and that they are less expensive.

Specific examples of the buffer agents include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalic-ylate), which, however, do not limit the present invention in any way.

The buffer agent is added to the color developer in an amount of preferably 0.1 mol per liter or more, particularly preferably 0.1 mol to to 0.4 mol per liter.

In addition, various chelating agents may be used in the color developer as agents for preventing precipitation of calcium or magnesium or for improving stability of the color developer.

Nonlimitative examples of the chelating agents are illustrated below: nitrilotriacetic acid, diethylenetriaminepentaacetic acid, ethylenediaminetetraacetic acid, triethylenetetraminehexaacetate, N,N,N-trimethylenephosphonic acid, ethylenediamine-N,N,N',N'-tetramethylenephosphonic acid, 1,3-diamino-2-propanoltetraacetic acid, trans-cyclohexanediaminetetraacetic acid, nitrilotripropionic acid, 1,2-diaminopropanetetraacetic acid, hydroxyethyliminodiacetic acid, glycol ether diaminetetraacetic acid, hydroxyethylenediaminetriacetic acid, ethylenediamine-o-hyiroxyphen-ylacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, catechol-3,4,6-trisulfonic acid, catechol-3,5-disulfonic acid, 5-sulfosalicylic acid and 4-sulfosalicylic acid.

These chelating agents may be used as a combination of two or more, if desired.

The chelating agent may be added in an amount sufficient to mask metal ions in the color developer. For example, it is generally added in an amount of about 0.1 g to about 10 g per liter.

An optional developing accelerator may be added to the color developer, if desired.

As a developing accelerator, there may be added, if desired, thioether compounds described, for example, in JP-B-37-16088, JP-B-37-5987, JP-B-38-7826, JP-B-44-12380, JP-B-45-9019 and U.S. Pat. No. 3,813,247, p-phenylenediamine compounds described in JP-A-52-49829 and JP-A-50-155554, quaternary ammonium salts described, for example, in JP-A-50-137726, JP-B-44-30074, JP-A-56-156826 and JP-A-52-43429, p-aminophenols described in U.S. Pat. Nos. 2,610,122 and 4,119,462, amino compounds described, for example, in U.S. Pat. Nos. 2,494,903, 3,128,182, 4,230,796, 3,253,919, JP-B-41-11431, U.S. Pat. Nos. 2,482,546, 2,596,926 and 3,582,346, polyalkylene oxides described, for example, in JP-B-37-16088, JP-B-42-25201, U.S. Pat. No. 3,128,183, JP-B-41-11431, JP-B-42-23883 and U.S. Pat. No. 3,532,501, 1-phenyl-3-pyrazolidones, hydrazines, isoionic compounds, ionic compounds, imidazoles, and the like.

The color developer preferably does not contain substantially benzyl alcohol. The term "not contain substantially" means to contain in an amount of up to 2.0 ml per liter of the developer, more preferably in no amount. Not containing substantially benzyl alcohol causes less accumulation thereof in a bleach-fixing solution during continuous processing and prevents color restoration failure, generation of stain or processing unevenness, thus better results being obtained.

In the present invention, an optional antifogging agent may be added, if desired, in addition to a halide ion such as a chloride ion or a bromide ion. As the antifogging agent, alkali metal halides such as potassium iodide and organic antifogging agents may be used. Typical examples of the organic antifogging agents include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine, adenine, etc.

The color developer to be used in the present invention preferably contains a fluorescent brightening agent. As the fluorescent brightening agent, 4,4'-diamino-2,2'-disulfostilbene compounds are preferable. The fluorescent brightening agent is added in an amount of from 0 to 10 g/liter, preferably from 0.1 to 6 g/liter.

If desired, various surface active agents such as alkylsulfonic acids, arylphosphonic acids, aliphatic carboxylic acids, aromatic carboxylic acids, etc., may further be added.

As to the time for processing in the color developer in accordance with the present invention, a processing time of 10 seconds to 120 seconds, preferably 20 seconds to 60 seconds, provides marked advantages of the present invention. The processing temperature is generally 33° to 45° C., preferably 35° to 40° C.

As to the amount of the replenishing color developer (i.e., the color developer for replenishment) in continuous processing, an amount of 20 to 220 ml per $m^2$, particularly 40 to 140 ml per $m^2$, of the light-sensitive material is preferable since the advantages of the present invention can be effectively obtained.

Furthermore, buffer agents, fluorescent brightening agents, chelating agents, antifungal agents, etc., may be added, if desired.

The time for processing with the bleach-fixing solution to be used in the present invention is from 10 seconds to 120 seconds, preferably from 20 seconds to 60 seconds. The processing temperature is generally 25° to 45° C., preferably 30° to 40° C. The amount of replenishing solution is 30 ml to 250 ml, preferably 40 ml to 150 ml per $m^2$, of the light-sensitive material. A decrease in the amount of replenishing solution generally leads to an increase in stain and the possibility of desilvering failure. In accordance with the present invention, however, the amount of replenishing bleach-fixing solution (i.e., bleach-fixing solution for replenishment) can be decreased without causing the above described problems.

The silver halide color photographic material of the present invention is generally subjected to a water washing step and/or a stabilizing step after the bleach-fixing processing.

The amount of water to be used in the water washing step may be selected from a wide range depending upon characteristic properties of light-sensitive material (e.g., resulting from the kinds of materials such as couplers), end use, temperature of the washing water, number of washing tanks (step number), replenishing manner (e.g., countercurrent system or cocurrent system) and other various factors. Of these, the relationship between the number of water washing tanks and the amount of water in a multistage countercurrent system can be determined according to the method described in *Journal of the Society of Motion Picture and Television Engineers*, Vol. 64, pages 248 to 253 (May, 1955).

The multistage countercurrent system described in the above mentioned literature enables the amount of water to be markedly decreased. However, an increased residence time of water in the tank causes another problem in that suspended matter is produced as a result of the propagation of bacteria. In processing the color light-sensitive material according to the present invention, it is extremely effective to reduce the contents of calcium and magnesium as described in JP-A-62-288838 for solving the above described problem. In addition, isothiazolone compounds and thiabendazoles described in JP-A-57-8542, chlorine-containing bactericides such as sodium chlorinated isocyanurate, and bactericides such as benzotriazoles described in Hiroshi Horiguchi, *Bokin Bobaizai no Kagaku* (*Chemistry of Antibacterial and Antifungal Agents*), Eisei Gijutsu-kai, *Biseibutsu no Mekkin, Sakkin, Bobaigijutsu* (*Sterilizing and Antifungal Techniques against Microorganisms*), and Nihon Bokin Bobai Gakkai (The Japanese Antibacterial and Antifungal Society), *Bokin Bobaizai Jiten* (*Antibacterial and Antifungal Book*) may also be used.

The pH of the washing water to be used in processing the light-sensitive material of the present invention ranges generally from 4 to 9, preferably from 5 to 8. The temperature and time of washing may also be varied depending upon the characteristic properties of the light-sensitive material, end use, etc., but, as a general guide, a washing temperature of 15° to 45° C. and a washing time of 20 seconds to 2 minutes, preferably a washing temperature of 25° to 40° C. and a washing time of 30 seconds to 1 minute and 30 seconds, are selected.

In accordance with the present invention, good photographic properties can be obtained without increased stain even by the above described short time washing with water.

Further, the light-sensitive material of the present invention may be processed directly with a stabilizing solution in place of the above mentioned washing water. In such stabilizing processing, all of the known techniques described in JP-A-57-8543, JP-A-58-14834, JP-A-59-184343, JP-A-60-220345, JP-A-60-238832, JP-A-60-239784, JP-A-60-239749, JP-A-61-4054, JP-A-61-118749, etc., may be employed. In particular, a stabilizing bath containing 1-hydroxyethylidene-1,1-diphosphonic acid, 5-chloro-2-methyl-4-isothiazolin-3-one, a bismuth compound, an ammonium compound or the like is preferably used.

In addition, the aforesaid water washing is in some cases followed by stabilizing. An example thereof is a stabilizing bath containing formalin and a surface active agent, which is used as a final bath for processing color light-sensitive materials for photographing use.

The silver halide color photographic material to be used in the present invention is now described in detail below.

The silver halide emulsion to be used in the present invention substantially comprises silver chloride. The term "substantially comprises silver chloride" means that the content of silver chloride based on the amount of total silver halide is 80 mol% or more, preferably 95 mol% or more, more preferably 98 mol% or more. From the point of desilvering properties, the higher the content of silver chloride, the more preferable. The silver chloride-rich emulsion (i.e., the high silver chloride emulsion) of the present invention may contain a small amount of silver bromide or silver iodide. In some cases, the presence of silver halide other than silver chloride serves to provide advantages as to photosensitivity such as an increased amount of light absorption, a strengthened adsorption of a spectral sensitizing dye and a decreased desensitization caused by a spectral sensitizing dye.

Silver halide grains contained in a photographic emulsion layer of the photographic light-sensitive material to be used in the present invention may have a layered crystal structure wherein the inner portion and the outer portion are different from each other in phase composition, a multiphase conjunction structure, or a uniform structure, or, further, may comprise a mixture of them.

Silver halide grains in the photographic emulsion may be in a regular crystal form such as cubic, octahedral or tetradecahedral form, in an irregular crystal form such as a spherical or tabular form, in a form with crystal defects such as twin plane, or in a composite form thereof.

As to grain size of the silver halide grains, both fine grains of not larger than about 0.2 μm and large sized grains of up to about 10 μm in projected area diameter may be used. The emulsion may be a polydisperse emulsion or a monodisperse emulsion.

The silver halide photographic emulsion to be used in the present invention may be prepared according to processes described, for example, in *Research Disclosure* (*RD*), No. 17643 (December, 1978), pages 22 and 23, "I. Emulsion preparation and types".

Monodisperse emulsions described, for example, in U.S. Pat. Nos. 3,574,628, 3,655,394 and British Patent 1,413,748 are also preferable.

Tabular grains of about 5 or more in aspect ratio are also usable in the present invention. Such tabular grains may be easily prepared according to processes described, for example, in Gutoff, *Photographic Science and Engineering*, Vol. 14, pages 248 to 257 (1970), U.S. Pat. Nos 4,434,226, 4,414,310, 4,433,048, 4,439,520 and British Patent 2,112,157.

The crystal structure may be a uniform structure, a structure wherein the inner portion and the outer portion are different from each other in halide composition, or a layered structure. Or silver halide crystals different from each other may be conjuncted to each other by epitaxial conjunction or, further, crystals conjuncted to other compounds than silver halide such as silver rhodanide or lead oxide may be used.

In addition, a mixture of grains of various crystal forms may also be used.

The silver halide emulsions to be used in the present invention are usually subjected to physical ripening, chemical ripening and spectral sensitization before use. Additives to be used in these steps are described in *Research Disclosure*, Nos. 17643 and 18716. Places where such additives are described are tabulated in the table to be shown hereinafter.

The silver halide of the present invention is coated in a silver amount of generally 1 g to 0.4 g, preferably 0.8 g to 0.4 g, per $m^2$. A smaller amount is better from the viewpoint of improving desilvering properties and removing processing unevenness.

Known photographic additives to be used in the present invention are also described in the above described two *Research Disclosures*, and the related descriptions are shown in the following table.

| Additives | RD 17643 | RD 18716 |
|---|---|---|
| 1. Chemical Sensitizers | Page 23 | Page 648, right column |
| 2. Sensitivity Increasing Agents | — | Page 648, right column |
| 3. Spectral Sensitizers, Supersensitizers | Pages 23–24 | Page 648, right column to page 649, right |

-continued

| Additives | RD 17643 | RD 18716 |
|---|---|---|
| | | column |
| 4. Brightening Agents | Page 24 | — |
| 5. Antifoggants and Stabilizers | Pages 24–25 | Page 649, right column |
| 6. Light Absorbers, Filter Dyes, and Ultraviolet Absorbers | Pages 25–26 | Page 649, right column to page 650, left column |
| 7. Antistaining Agents | Page 25, right column | Page 650, left to right columns |
| 8. Dye Image Stabilizers | Page 25 | — |
| 9. Hardeners | Page 26 | Page 651, left column |
| 10. Binders | Page 26 | Page 651, left column |
| 11. Plasticizers and Lubricants | Page 27 | Page 650, right column |
| 12. Coating Aids and Surface Active Agents | Pages 26–27 | Page 650, right column |
| 13. Antistatic Agents | Page 27 | Page 650, right column |

Various color couplers may be used in the present invention, and specific examples thereof are described in the patents described in the foregoing *Research Disclosure,* No. 17643, VII-C to G.

As yellow couplers, those described, for example, in U.S. Pat. Nos. 3,933,501, 4,022,620, 4,326,024, 4,401,752, JP-B-58-10739, British Patents 1,425,020 and 1,476,760 are preferable.

In the present invention, couplers represented by formula (I) are particularly preferably used as yellow couplers for the purpose of accelerating desilvering rate and decreasing stain.

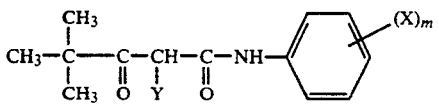

(I)

wherein X represents a substituent, preferably a halogen atom, an alkoxy group, $-NHCOR_1$, $-NHSO_2-R_1$, $-SO_2NHR_1$, $-COOR_1$, or

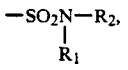

$R_1$ and $R_2$ each represents an unsubstituted alkyl group or a substituted alkyl group, preferably having 1 to 30 carbon atoms, provided that $(X)_m$ may represent two or more substituents which may be different, m represents an integer of 1 to 5, preferably 1 to 3, more preferably 2, and Y represents a releasing group represented by

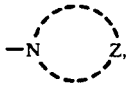

wherein Z represents a heterocyclic ring forming group. Preferably Y is represented by formulae (I-A), (I-B) or (I-C):

(I-A)

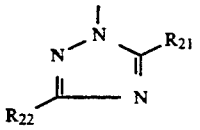

-continued (I-B)

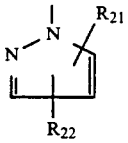

wherein $R_{21}$ and $R_{22}$, which may be the same or different, each represents a hydrogen atom, a halogen atom, a carboxylic acid ester group, an amino group, an alkyl group, an alkylthio group, an alkoxy group, an alkylsulfonyl group, a carboxylic acid group, a sulfonic acid group, an unsubstituted or substituted phenyl or heterocyclic ring. The total carbon atoms of the above groups for $R_{21}$ and $R_{22}$ are preferably 1 to 30.

(I-C)

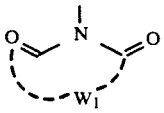

wherein $W_1$ represents nonmetallic atoms necessary for forming a 4-, 5- or 6-membered ring together with

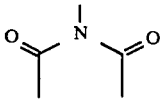

in the formula.

Of those which are represented by formula (I-C), those represented by (I-d) to (I-f) are preferable:

(I-d)

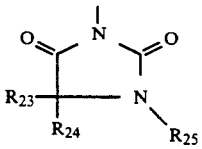

(I-e)

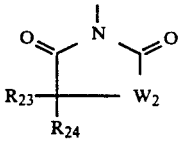

-continued (I-f)

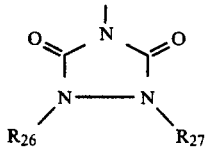

wherein $R_{23}$ and $R_{24}$ each represents a hydrogen atom, an alkyl group, an aryl group, an alkoxy group, an aryloxy group or a hydroxy group, $R_{25}$, $R_{26}$ and $R_{27}$ each represents a hydrogen atom, an alkyl group, an aryl group, an aralkyl group or an acyl group, and $W_2$ represents an oxygen or sulfur atom. The total carbon atoms of the above groups for $R_{23}$, $R_{24}$, $R_{25}$, $R_{26}$ and $R_{27}$ are preferably 1 to 30.

Specific examples of these couplers are illustrated below.

I-1

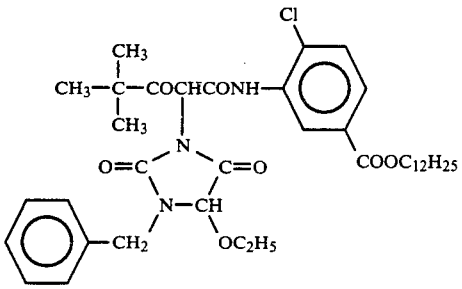

I-2

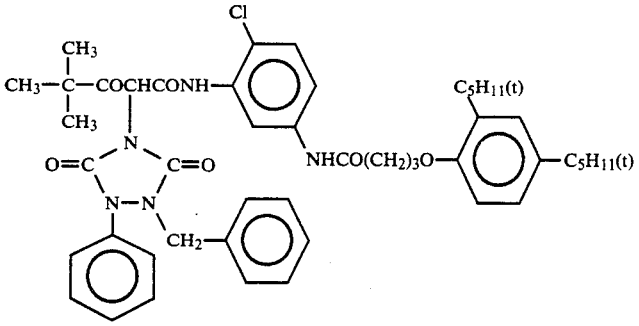

I-3

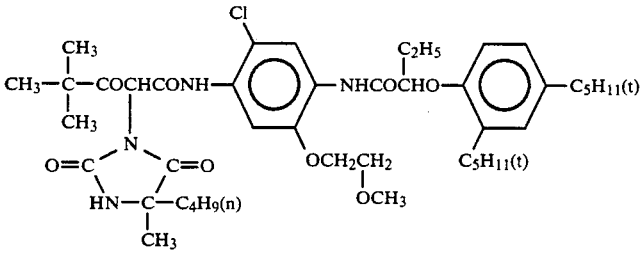

I-4

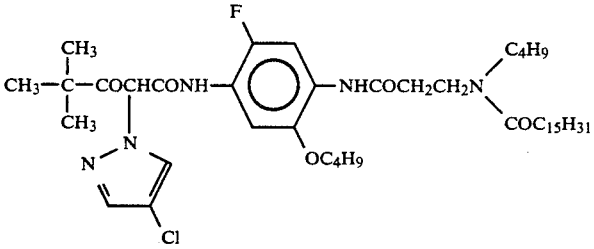

I-5

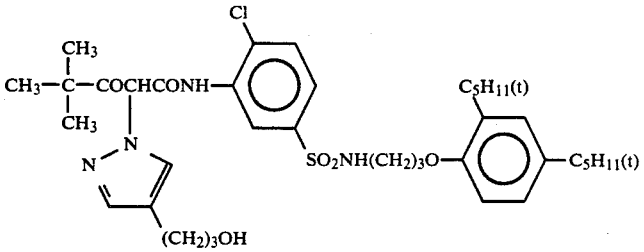

-continued
I-6
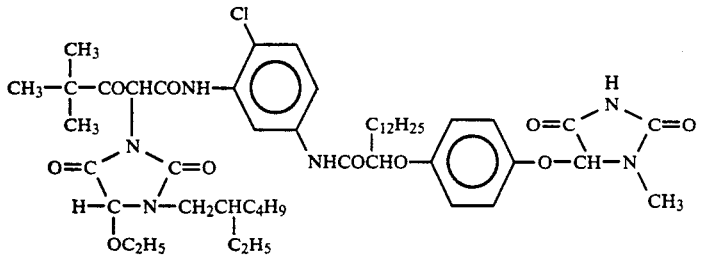
I-7
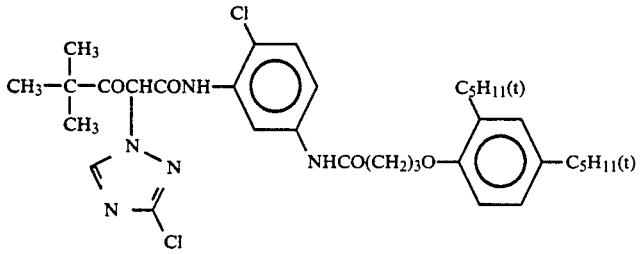
I-8
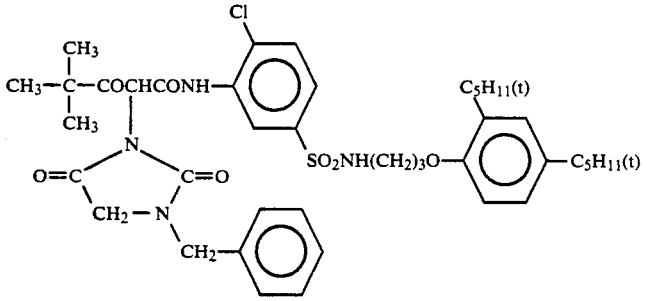
I-9
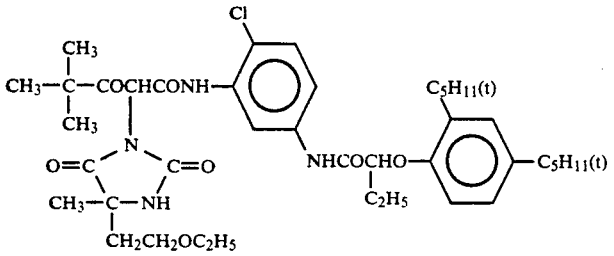
I-10
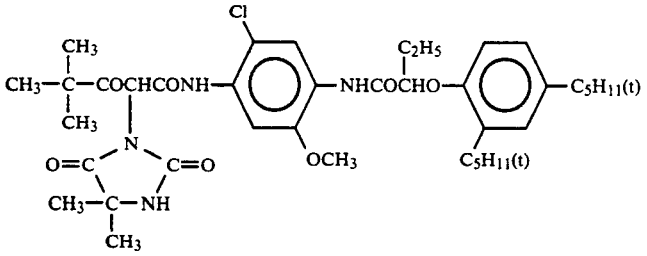
I-11
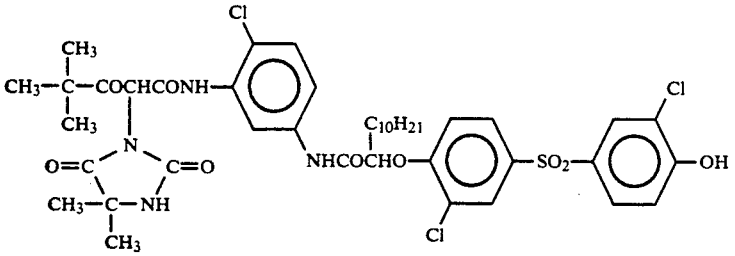

-continued
I-12
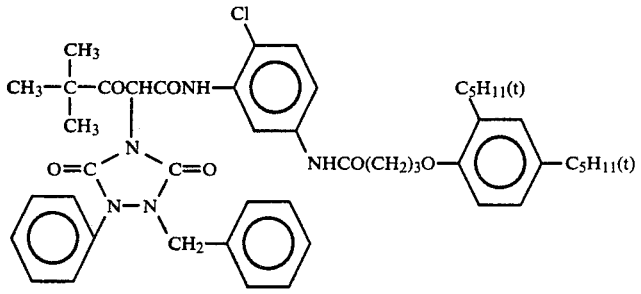
I-13
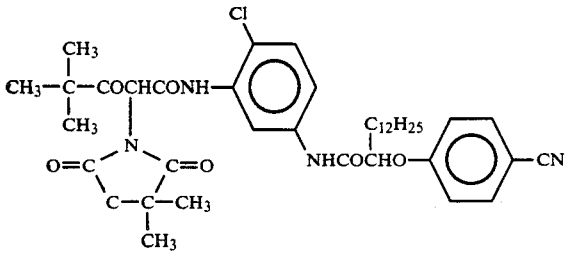
I-14
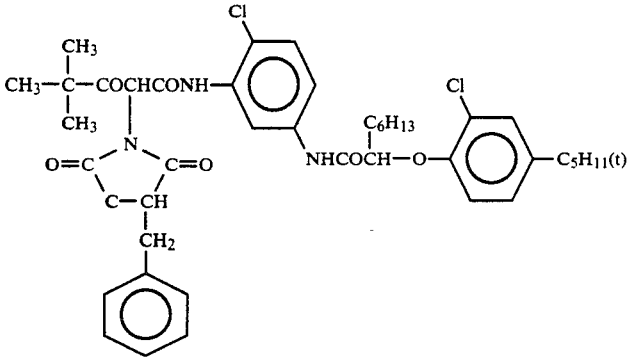
I-15
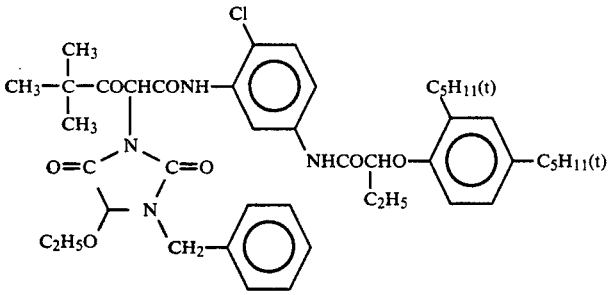
I-16
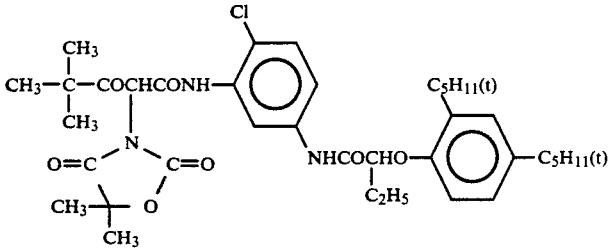

-continued

I-17

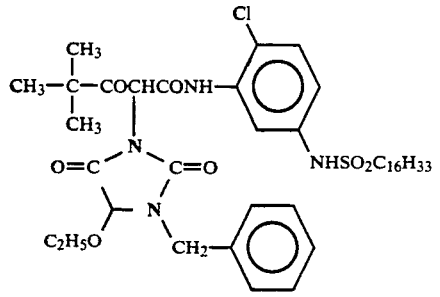

I-18

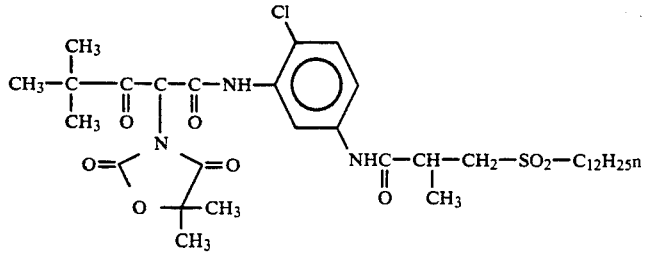

I-19

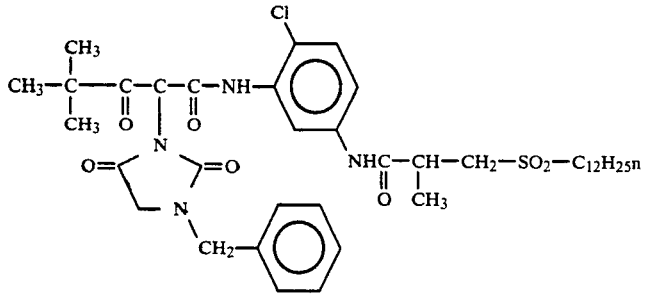

I-20

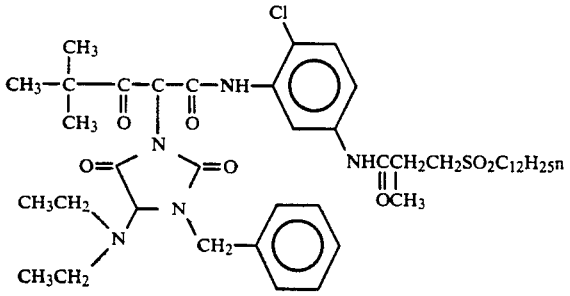

The amount of couplers represented by formula (I) which can be used in the present invention is generally $1\times10^{-4}$ to $1\times10^{-2}$ mol/m$^2$, preferably $5\times10^{-4}$ to $5\times10^{-3}$ mol/m$^2$.

As magenta couplers, 5-pyrazolone type and pyrazoloazole compounds are preferable, with those which are described in U.S. Pat. Nos. 4,310,619, 4,351,897, European Patent 73,636, U.S. Pat. Nos. 3,061,432, 3,725,067, *Research Disclosure,* No. 24220 (June, 1984), JP-A-60-33552, *Research Disclosure,* No. 24230 (June, 984), JP-A-60-43659, U.S. Pat. Nos. 4,500,630, 4,540,654, etc., being particularly preferred.

As cyan couplers, examples include phenolic and naphtholic couplers, and those which are described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, West German Patent (OLS) 3,329,729, European Patent 121,365A, U.S. Pat. Nos. 3,446,622, 4,333,999, 4,451,559, 4,427,767, European Patent 161,626A, etc., are preferred.

As colored couplers for correcting unnecessary absorption of colored dyes, those which are described in *Research Disclosure,* No. 17643, Item VII-G, U.S. Pat. No. 4,163,670, JP-B-57-39413, U.S. Pat. Nos. 4,004,929, 4,138,258, and British Patent 1,146,368 are preferred.

As couplers capable of forming colored dyes with a suitable diffusibility, those which are described in U.S. Pat. No. 4,366,237, British Patent 2,125,570, European Patent 96,570, and West German Patent (OLS) 3,234,533 are preferred.

Typical examples of polymerized dye forming couplers are described in U.S. Pat. Nos. 3,451,820, 4,080,211, 4,367,282, British Patent 2,102,173, etc.

Couplers capable of releasing a photographically useful residue upon a coupling reaction are also preferably used in the present invention. As DIR couplers capable of releasing a development inhibitor, those which are described in patents referred to in the foregoing *Research Disclosure,* No. 17643, Item VII-F, JP-A-57-151944, JP-A-57-154234, JP-A-60-184248, and U.S. Pat. No. 4,248,962 are preferred.

As couplers capable of imagewise releasing a nucleating agent or a developing accelerator upon the development, those which are described in British Patents 2,097,140, 2,131,188, JP-A-59-157638 and JP-A-59-170840 are preferred.

As other couplers to be used in the lightsensitive material of the present invention, examples include competing couplers described in U.S. Pat. No. 4,130,427, polyequivalent couplers described in U.S. Pat. Nos. 4,283,472, 4,338,393, 4,310,618, etc., DIR redox compound releasing couplers described in JP-A-60-185950, etc., couplers capable of color restoring after being released described in European Patent 173,302A, and the like.

The couplers to be used in the present invention may be introduced into light-sensitive material by various known dispersing processes.

Examples of high boiling solvents to be used in the oil-in-water dispersion processes are described, for example, in U.S. Pat. No. 2,322,027.

Steps and advantages of the latex dispersion process and specific examples of latex for impregnation are described, for example, in U.S. Pat. No. 4,199,363, West German Patents (OLS) 2,541,274 and 2,541,230.

Light-sensitive materials adapted for the process of the present invention may be any color photographic material such as color negative film, color reversal film, color paper, color positive film, color autopositive paper, and color reversal paper. Of these, color paper, color reversal paper and color autopositive paper are particularly preferably adapted for the process of the present invention.

The present invention is now illustrated in greater detail by reference to the following examples which, however, are not to be construed as limiting the present invention in any way.

Unless otherwise indicated, all percents, ratios, parts, etc., are by weight.

EXAMPLE 1

A multilayer color photographic paper comprising a paper support double laminated by polyethylene having a layer construction shown below was prepared. Coating solutions for its preparation were prepared as follows.

Preparation of Coating Solution for First Layer 27.2 ml of ethyl acetate and 8.2 g of a solvent (Solv-3) were added to 19.1 g of a yellow coupler (ExY), 4.4 g of a color image stabilizer (Cpd-1) and 0.7 g of a color image stabilizer to prepare a solution, and this solution was emulsified and dispersed in a 10% gelatin aqueous solution containing 8 ml of a 10% sodium dodecylbenzenesulfonate solution. Separately, a blue-sensitive emulsion was prepared by adding blue-sensitive sensitizing dyes shown below each in an amount of $2.0\times10^{-4}$ mol per mol of silver to a silver chlorobromide emulsion (cubic crystal form; average grain size: 0.88 μm; coefficient of variation of grain size distribution: 0.08; containing 0.2 mol % of silver bromide on the surface of the grains), and then subjecting it to sulfur sensitization. The aforesaid emulsion dispersion and this emulsion were mixed to prepare a coating solution for forming a first layer having the following formulation. Coating solutions for the second to seventh layers were also prepared in the same manner as the coating solution for the first layer. As a gelatin hardener for each layer, 1-hydroxy-3,5-dichloro-s-triazine sodium salt was used.

Spectral sensitizing dyes for respective layers are as follows.

Blue-Sensitive Emulsion Layer

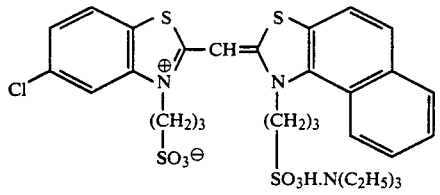

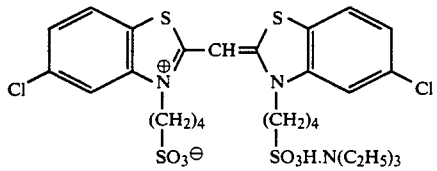

($2.0\times10^{-4}$ mol each per mol of silver halide)

Green-Sensitive Emulsion Layer

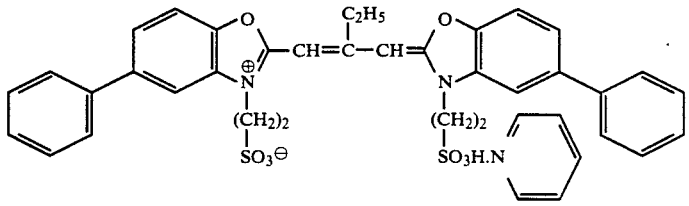

($4.0\times10^{-4}$ mol per mol of silver halide)

-continued and

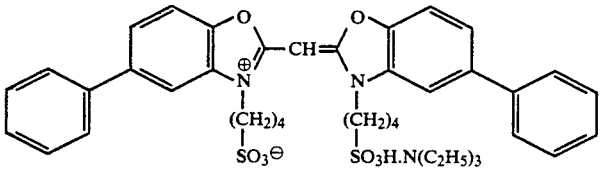

($7.0 \times 10^{-5}$ mol per mol of silver halide)

Red-Sensitive Emulsion Layer

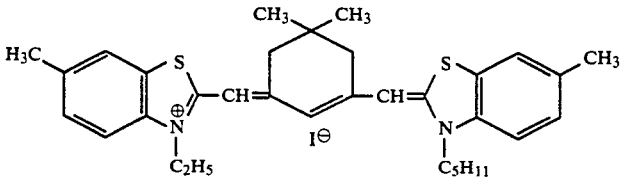

($0.9 \times 10^{-4}$ mol per mol of silver halide)

The following compound was added to the red-sensitive emulsion layer in an amount of $2.6 \times 10^{-3}$ mol per mol of silver halide.

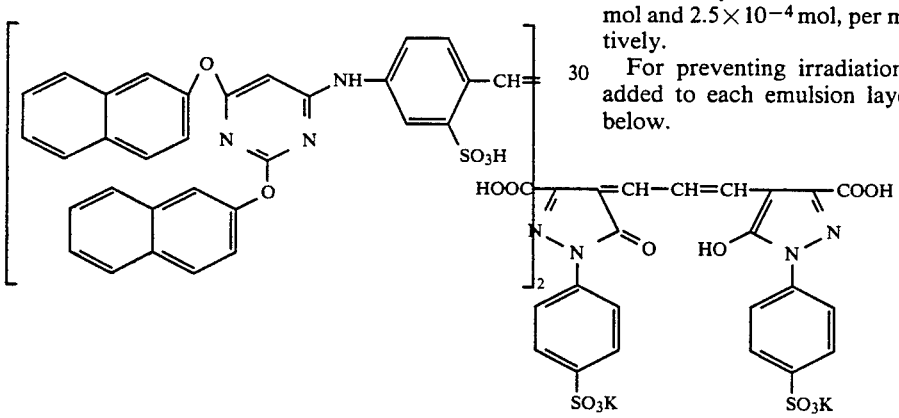

(5 mg per $m^2$)

and

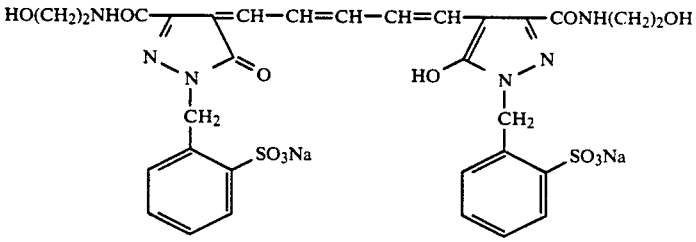

(10 mg per $m^2$)

In addition, 1-(5-methylureidophenyl)-5-mercaptotetrazole was added to the blue-sensitive emulsion layer, the green-sensitive emulsion layer and the red-sensitive emulsion layer in amounts of $8.5 \times 10^{-5}$ mol, $7.7 \times 10^{-4}$ mol and $2.5 \times 10^{-4}$ mol, per mol of silver halide, respectively.

For preventing irradiation, the following dye was added to each emulsion layer in the amounts shown below.

Layer Constitution

Formulation of each layer is shown below. Numerals represent coated amounts ($g/m^2$). Coated amounts of silver halide emulsion are shown in terms of silver amount.

Support

Polyethylene Laminated Paper (containing a white pigment ($TiO_2$) and a bluish dye (ultramarine))

First Layer: Blue-Sensitive Layer

-continued

| | |
|---|---|
| Silver Chlorobromide Emulsion | 0.30 |
| Gelatin | 1.86 |
| Yellow Coupler (ExY) | 0.82 |
| Color Image Stabilizer (Cpd-1) | 0.19 |
| Solvent (Solv-3) | 0.35 |
| Color Image Stabilizer (Cpd-7) | 0.06 |
| Second Layer: Color Mixing Preventing Layer | |
| Gelatin | 0.99 |
| Color Mixing Preventing Agent (Cpd-5) | 0.08 |
| Solvent (Solv-1) | 0.16 |
| Solvent (Solv-4) | 0.08 |
| Third Layer: Green-Sensitive Layer | |
| Silver Chlorobromide Emulsion (cubic; mixture of grains of 0.55 μm in average grain size and grains of 0.39 μm in average grain size in a mixing ratio of 1/3 (Ag mol ratio); coefficients of variation of grain size distribution: 0.10 and 0.08, respectively; containing 0.8 mol of AgBr localized on the surface of the grains) | 0.12 |
| Gelatin | 1.24 |
| Magenta Coupler (ExM) | 0.27 |
| Color Image Stabilizer (Cpd-3) | 0.15 |
| Color Image Stabilizer (Cpd-8) | 0.02 |
| Color Image Stabilizer (Cpd-9) | 0.03 |
| Solvent (Solv-2) | 0.54 |
| Fourth Layer: Ultraviolet Ray Absorbing Layer | |
| Gelatin | 1.58 |
| Ultraviolet Absorber (UV-1) | 0.47 |
| Color Mixing Preventing Agent (Cpd-5) | 0.05 |
| Solvent (Solv-5) | 0.24 |
| Fifth Layer: Red-Sensitive Layer | |
| Silver Chlorobromide Emulsion (cubic; mixture of grains of 0.58 μm in average grain size and grains of 0.45 μm in average grain size in a mixing ratio of 1/4 (Ag mol ratio); coefficients of variation of grain size distribution: 0.09 and 0.11, respectively; containing 0.6 mol of AgBr localized on the surface of the grains) | 0.23 |
| Gelatin | 1.34 |
| Cyan Coupler (ExC) | 0.32 |
| Color Image Stabilizer (Cpd-6) | 0.17 |
| Color Image Stabilizer (Cpd-10) | 0.04 |
| Color Image Stabilizer (Cpd-7) | 0.40 |
| Solvent (Solv-6) | 0.15 |
| Sixth Layer: Ultraviolet Ray Absorbing Layer | |
| Gelatin | 0.53 |
| Ultraviolet Absorber (UV-1) | 0.16 |
| Color Mixing Preventing Agent (Cpd-5) | 0.02 |
| Solvent (Solv-5) | 0.08 |
| Seventh Layer: Protective Layer | |
| Gelatin | 1.33 |
| Acryl Modified Copolymer of Polyvinyl Alcohol (modification degree: 17%) | 0.17 |
| Liquid Paraffin | 0.03 |

(ExY) Yellow Coupler

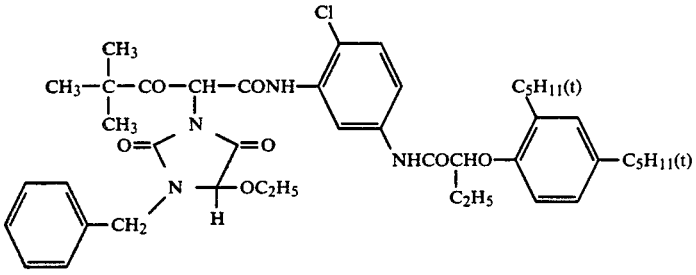

(ExM) Magenta Coupler

-continued
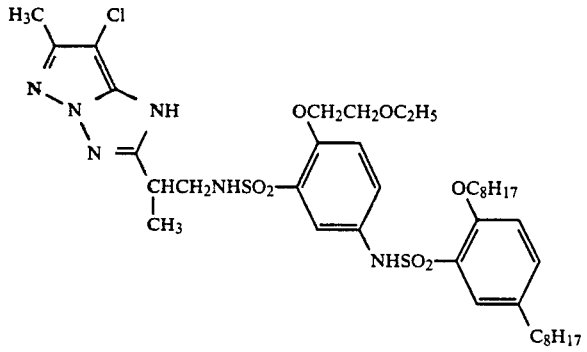
(ExC) Cyan Coupler
A 2/4/4 (by weight) mixture of
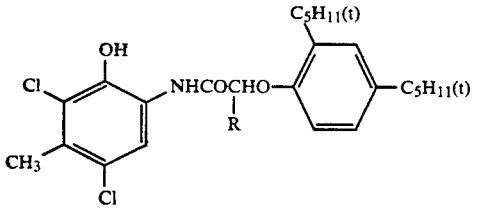
R = $C_2H_5$, $C_4H_9$
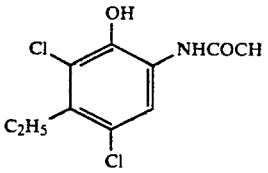
(Cpd-1) Color Image Stabilizer
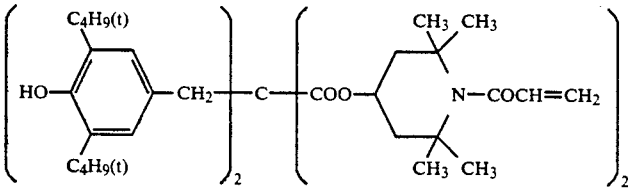
(Cpd-3) Color Image Stabilizer
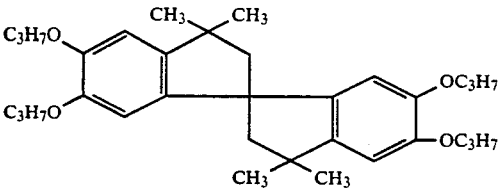
(Cpd-5) Color Mixing Preventing Agent
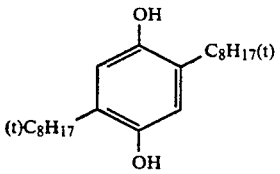
(Cpd-6) Color Image Stabilizer
A 2/4/4 (by weight) mixture of -continued
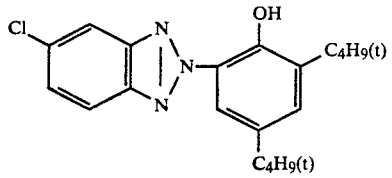
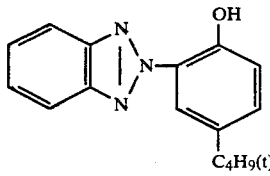
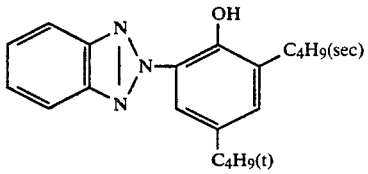
(Cpd-7) Color Image Stabilizer
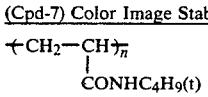
(average molecular weight: 60,000)
(Cpd-8) Color Image Stabilizer
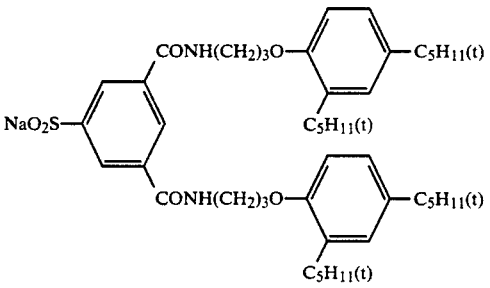
(Cpd-9) Color Image Stabilizer
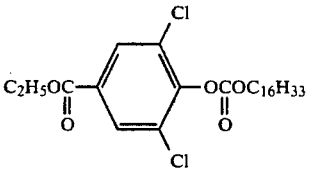
(Cpd-10) Color Image Stabilizer
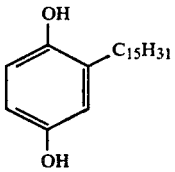
(UV-1) Ultraviolet Absorber
A 4/2/4 (by weight) mixture of
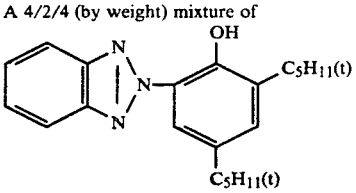

-continued

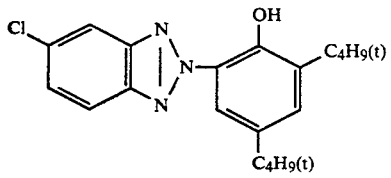

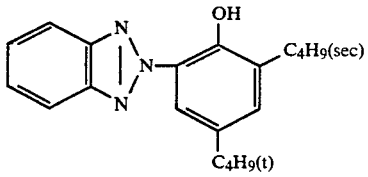

(Solv-1) Solvent

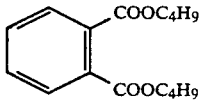

(Solv-2) Solvent

A 2/1 (by volume) mixture of

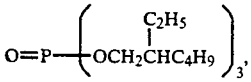

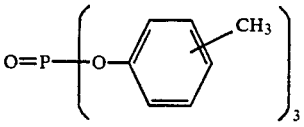

(Solv-3) Solvent $O{=}P{-}[O{-}C_9H_{19}(iso)]_3$ (Solv-4) Solvent

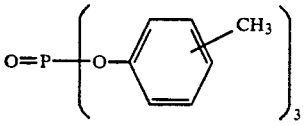

(Solv-5) Solvent

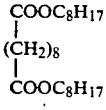

(Solv-6) Solvent

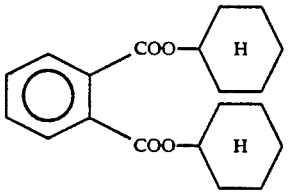

The thus obtained sample was referred to as Sample I-A. Samples I-B to I-E were prepared in the same manner as in Sample I-A except for changing the halide formulation of the silver halide emulsion as shown in the following table.

| Sample No. | Blue-Sensitive Layer (Cl %) | Green-Sensitive Layer (Cl %) | Red-Sensitive Layer (Cl %) |
|---|---|---|---|
| I-A | 99.8 | 99.2 | 99.4 |
| I-B | 95.0 | 95.2 | 95.2 |

-continued

| Sample No. | Blue-Sensitive Layer (Cl %) | Green-Sensitive Layer (Cl %) | Red-Sensitive Layer (Cl %) |
|---|---|---|---|
| I-C | 90.0 | 91.2 | 91.2 |
| I-D | 80.3 | 81.0 | 81.0 |
| I-E | 72.3 | 71.8 | 71.8 |

The above described Samples I-A to I-E were imagewise exposed, then subjected to continuous processing according to the following processing steps.

| Processing Step | Temperature (°C.) | Time (sec) | Replenishing Amount* (ml) | Tank Volume (l) |
|---|---|---|---|---|
| Color Development | 35 | 45 | 161 | 4 |
| Bleach-Fixing | 30–36 | 45 | 218 | 4 |
| Washing (1) | 30–37 | 30 | — | 2 |
| Washing (2) | 30–37 | 30 | — | 2 |
| Washing (3) | 30–37 | 30 | 364 | 2 |
| Drying | 70–85 | 60 | — | — |

*Replenishing amount per $m^2$ of light-sensitive material (Washing was conducted in a three tank countercurrent system of Washing (3) to Washing (1))

Formulation of each processing solution is as follows.

| Color Developer: | Tank Solution | Replenisher |
|---|---|---|
| Water | 800 ml | 800 ml |
| Ethylenediamine-N,N,N',N'-tetramethylenephosphonic Acid | 3.0 g | 3.0 g |
| Triethanolamine | 8.1 g | 11.0 g |
| Potassium Chloride | 1.6 g | — |
| Potassium Bromide | 0.010 g | — |
| Potassium Carbonate | 25 g | 25 g |
| N-Ethyl-N-(β-methanesulfonamidoethyl)-3-methyl-4-aminoaniline Sulfate | 5.0 g | 7.0 g |
| N,N-Diethylhydroxylamine | 4.0 g | 7.0 g |
| Fluorescent Brightening Agent (WHITEX-4, made by Sumitomo Chemical Co., Ltd.) | 1.25 g | 1.8 g |
| Water to make | 1,000 ml | 1,000 ml |
| pH (25° C.) | 10.05 | 10.45 |
| Bleach-Fixing Solution: | | |
| (tank soln. equals replenisher) | | |
| Water | 400 ml | |
| Ammonium Thiosulfate (70%) | 100 ml | |
| Ammonium Sulfite | 38 g | |
| Iron (III) Ammonium Ethylenediaminetetraacetate | 55 g | |
| Disodium Ethylenediaminetetraacetate | 5 g | |
| Glacial Acetic Acid | 9 g | |
| Water to make | 1,000 ml | |
| pH (25° C.) | 5.40 | |
| Washing Solution: | | |
| (The tank solution and the replenisher have the same formulation.) | | |

Ion Exchanged Water (content of calcium and magnesium: both not more than 3 ppm)

Regeneration of the used bleach-fixing solution was conducted in the following manner. When 4 liters of an overflow solution collected, a predetermined amount of silver was recovered therefrom using an electrolytic silver recovering apparatus shown in FIGS 1 and 2 of JP-A-53-40491, then regenerating agents shown below were added thereto to use the overflow solution as a regenerated replenisher. Collection of the overflow solution and regeneration thereof were further repeatedly conducted.

| Regenerating Agent: | |
|---|---|
| (amounts per liter of overflow solution) | |
| Ammonium Thiosulfate (70%) | 20 ml |
| Ammonium Sulfite | 15 g |
| Iron (III) Ammonium Ethylenediaminetetraacetate | 10 g |
| Disodium Ethylenediaminetetraacetate | 1.0 g |
| Glacial Acetic Acid | 20 g |
| Additionally, the pH of the replenisher was adjusted to 5.40. | |

The silver recovering procedure was conducted under three different conditions shown below with respective runnings.

| | Pole-to-Pole Voltage (V) | Solution Feeding Amount (ml/hr) |
|---|---|---|
| Condition 1 | 25 | 150 |
| Condition 2 | 15 | 300 |
| Condition 3 | 10 | 4,000 |

Each of the above described recovering procedures was repeated 20 cycles, and the silver ion concentration at that point was analyzed according to an atomic absorption method. The results thus obtained are shown in Table 1.

Furthermore, Samples I-A to I-E were wedge exposed and processed, and the amount of residual silver in maximum density portion of each of the processed samples was analyzed according to a fluorescent X-ray method. The results thus obtained are shown in Table 1.

In order to evaluate color restoration failure, processed samples were treated with a bleaching solution for color negative film, CN-16$N_2$ (made by Fuji Photo Film Co., Ltd.), at 25° C. for 4 minutes to determine the variation in cyan density. That is, the coloration ratio (%) was determined as a density before the retreatment taking a density of 2.0 after the retreatment as 100%.

An increase in minimum density of yellow density ($\Delta D_E$min) from the start as a result of running processing was determined.

The results thus obtained are tabulated in Table 1.

TABLE 1

| Sample No. | Silver Amount (mol/liter) | Residual Silver (μg/$cm^2$) | Coloration Ratio (%) | $\Delta D_E$min |
|---|---|---|---|---|
| | | Condition 1 | | |
| I-A | 0.016 | 3 | 83 | +0.04 |
| I-B | 0.017 | 4 | 84 | +0.04 |
| I-C | 0.017 | 3 | 85 | +0.04 |
| I-D | 0.017 | 3 | 85 | +0.04 |
| I-E | 0.016 | 4 | 87 | +0.04 |
| | | Condition 2 | | |
| I-A | 0.024 | 2 | 98 | +0.01 |
| I-B | 0.026 | 3 | 98 | +0.01 |
| I-C | 0.023 | 5 | 97 | +0.02 |
| I-D | 0.024 | 7 | 95 | +0.03 |
| I-E | 0.024 | 13 | 91 | +0.04 |
| | | Condition 3 | | |
| I-A | 0.055 | 3 | 100 | +0.01 |
| I-B | 0.054 | 4 | 100 | +0.01 |
| I-C | 0.058 | 7 | 99 | +0.01 |
| I-D | 0.053 | 10 | 98 | +0.02 |

TABLE 1-continued

| Sample No. | Silver Amount (mol/liter) | Residual Silver ($\mu g/cm^2$) | Coloration Ratio (%) | $\Delta D_E min$ |
|---|---|---|---|---|
| I-E | 0.056 | 17 | 95 | +0.03 |

Data within the scope of the present invention are enclosed as [ ].

When Samples I-A, I-B, I-C and I-D containing the silver chloride-rich emulsions (i.e., the high silver chloride emulsions) in accordance with the present invention were processed with a replenisher containing silver in an amount of 0.02 mol/liter or more (Conditions 2 and 3), the desilvering was not delayed, less color restoration failure of cyan and a less increase in yellow stain resulted, thus good running results were obtained. Particularly remarkable advantages were obtained with Samples I-A and I-B using emulsions having a silver chloride content of 95 mol % or more.

EXAMPLE 2

Samples II-A, II-B, II-C, II-D and II-E were prepared in the same manner as in Example 1 except for changing the yellow coupler in Sample I-A of Example 1 as follows, and processed with the running solution used for Sample I-A in Example 1 to determine the residual silver amount and the coloration ratio in the same manner.

Sample II-A: I-16
Sample II-B: I-17
Sample II-C: I-19
Sample II-D:

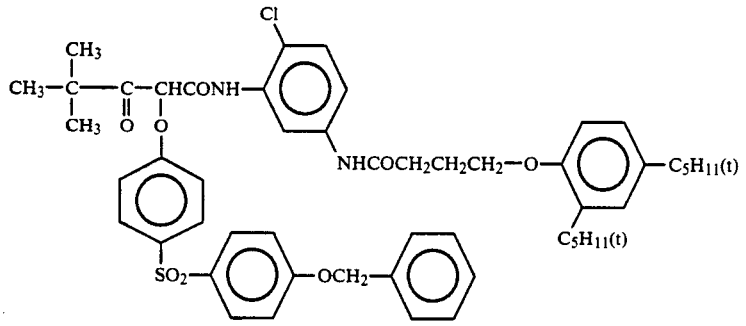

Sample II-E:

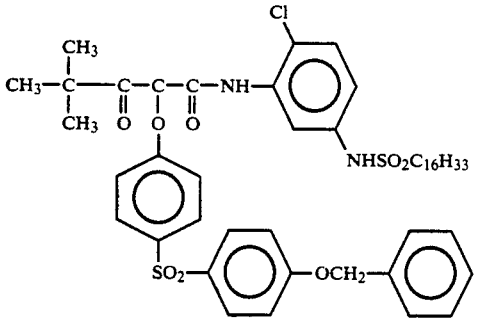

The results thus obtained are shown in Table 2.

TABLE 2

| Sample No. | Silver Amount (mol/liter) | Residual Silver ($\mu g/cm^2$) | Coloration Ratio (%) |
|---|---|---|---|
| | Condition 1 | | |
| I-A | 0.016 | 3 | 83 |
| II-A | " | 4 | 84 |
| II-B | " | 4 | 83 |
| II-C | " | 3 | 83 |
| II-D | " | 3 | 82 |
| II-E | " | 4 | 84 |
| | Condition 2 | | |
| I-A | 0.024 | 3 | 98 |
| II-A | " | 3 | 98 |
| II-B | " | 3 | 97 |
| II-C | " | 3 | 97 |
| II-D | " | 5 | 94 |
| II-E | " | 6 | 93 |
| | Condition 3 | | |
| I-A | 0.055 | 4 | 100 |
| II-A | " | 4 | 100 |
| II-B | " | 4 | 100 |
| II-C | " | 4 | 100 |
| II-D | " | 7 | 96 |
| II-E | " | 8 | 95 |

Data within the scope of the present invention are enclosed as [ ].

It is clearly seen from the results of Table 2 that an excellent coloration ratio of, particularly, cyan can be obtained by the present invention and that Samples I-A, II-A, II-B and II-C using yellow couplers represented by formula (I) as yellow couplers are preferable since they showed excellent desilvering properties and coloration ratios.

EXAMPLE 3

A multilayer color photographic paper comprising a paper support double laminated by polyethylene having provided thereon a layer construction shown below was prepared. Coating solutions for its preparation were prepared as follows.

Preparation of Coating Solution for First Layer 27.2 ml of ethyl acetate and 8.2 g of a solvent (Solv-3) were added to 19.1 g of a yellow coupler (ExY), 4.4 g of a color image stabilizer (Cpd-1) and 0.7 g of a color image stabilizer to prepare a solution, and this solution was emulsified and dispersed in a 10% gelatin aqueous solution containing 8 ml of a 10% sodium dodecylbenzenesulfonate solution. Separately, a blue-sensitive emulsion was prepared by adding blue-sensitive sensitizing dyes shown below each in an amount of $2.0\times10^{-4}$ mol per mol of silver to a silver chlorobromide emulsion (cubic crystal form; average grain size: 0.85 μm; coefficient of variation of grain size distribution: 0.07; containing 1.0 mol % of silver bromide locally on the surface of the grains), and then subjecting it to sulfur sensitization. The aforesaid emulsion dispersion and this emulsion were mixed to prepare a coating solution for forming a first layer having the following formulation. Coating solution for second to seventh layers were also prepared in the same manner as the coating solution for the first layer. As a gelatin hardener for each layer, 1-hydroxy-3,5-dichloro-s-triazine sodium salt was used.

Spectral sensitizing dyes for respective layers are as follows.

Blue-Sensitive Emulsion Layer

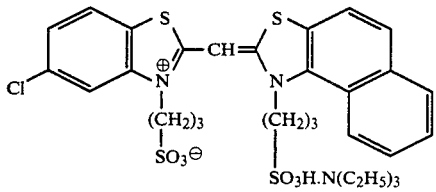

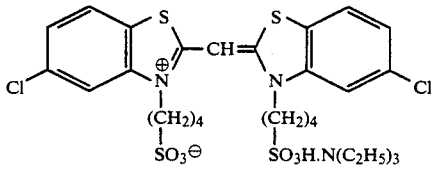

($2.0\times10^{-4}$ mol each per mol of silver halide)

Green-Sensitive Emulsion Layer

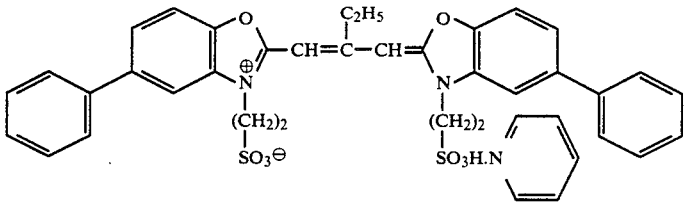

($4.0\times10^{-4}$ mol per mol of silver halide)

and

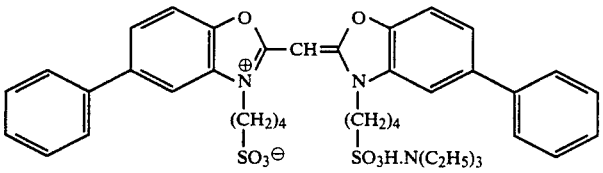

($7.0\times10^{-5}$ mol per mol of silver halide)

Red-Sensitive Emulsion Layer

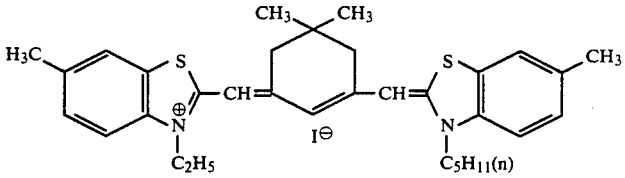

($0.9\times10^{-4}$ mol per mol of silver halide)

The following compound was added to the red-sensitive emulsion layer in an amount of $2.6\times10^{-3}$ mol per mol of silver halide.

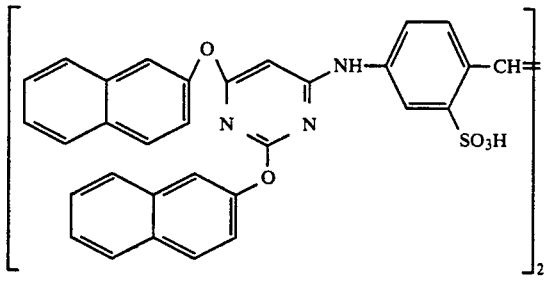

In addition, 1-(5-methylureidophenyl)-5-mercaptotetrazole was added to the blue-sensitive emulsion layer, the green-sensitive emulsion layer and the red-sensitive emulsion layer in amounts of $8.5\times10^{-5}$ mol, $7.7\times10^{-4}$ mol and $2.5\times10^{-4}$ mol, per mol of silver halide, respectively.

For preventing irradiation, the following dyes were added to each emulsion layer each in an amount of 4 mg/m$^2$.

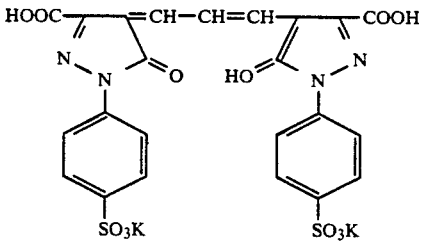

and

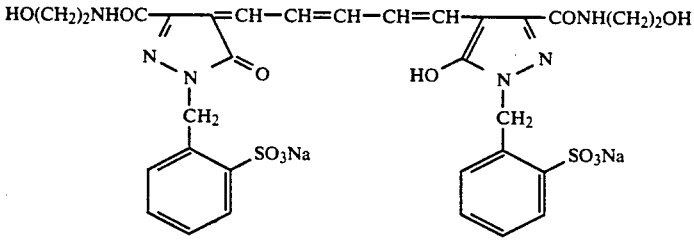

Layer Constitution

Formulation of each layer is shown below. Numerals represent coated amounts (g/m$^2$). Coated amounts of the silver halide emulsion are shown in terms of silver amount.

Support

Polyethylene Laminated Paper (containing a white pigment ($TiO_2$) and a bluish dye (ultramarine))

| | |
|---|---|
| First Layer: Blue-Sensitive Layer | |
| Silver Chlorobromide Emulsion Mentioned Hereinbefore | 0.30 |
| Gelatin | 1.86 |
| Yellow Coupler (ExY) | 0.82 |
| Color Image Stabilizer (Cpd-1) | 0.19 |
| Color Image Stabilizer (Cpd-7) | 0.03 |
| Solvent (Solv-3) | 0.35 |
| Second Layer: Color Mixing Preventing Layer | |
| Gelatin | 0.99 |
| Color Mixing Preventing Agent (Cpd-5) | 0.08 |

-continued

| | |
|---|---|
| Solvent (Solv-1) | 0.16 |
| Solvent (Solv-4) | 0.08 |
| Third Layer: Green-Sensitive Layer | |
| Silver Chlorobromide Emulsion (cubic grains of 0.40 μm in grain size and 0.09 in coefficient of variation; containing 1 mol % of AgBr localized on the surface of grains) | 0.25 |
| Gelatin | 1.24 |
| Magenta Coupler (ExM) | 0.29 |
| Color Image Stabilizer (Cpd-3) | 0.09 |
| Color Image Stabilizer (Cpd-4) | 0.06 |
| Solvent (Solv-2) | 0.32 |
| Solvent (Solv-7) | 0.16 |
| Fourth Layer: Ultraviolet Ray Absorbing Layer | |
| Gelatin | 1.58 |
| Ultraviolet Absorber (UV-1) | 0.47 |
| Color Mixing Preventing Agent (Cpd-5) | 0.05 |
| Solvent (Solv-5) | 0.24 |
| Fifth Layer: Red-Sensitive Layer | |
| Silver Chlorobromide Emulsion (cubic grains of 0.36 μm in grain size and 0.11 in coefficient of variation; containing 1.6 mol % of ArBr localized on the surface of grains) | 0.21 |
| Gelatin | 1.34 |
| Cyan Coupler (ExC) | 0.34 |
| Color Image Stabilizer (Cpd-6) | 0.17 |
| Color Image Stabilizer (Cpd-7) | 0.34 |
| Solvent (Solvent) | 0.37 |
| Sixth Layer: Ultraviolet Ray Absorbing Layer | |
| Gelatin | 0.53 |
| Ultraviolet Absorber (UV-1) | 0.16 |
| Color Mixing Preventing Agent (Cpd-5) | 0.02 |
| Solvent (Solv-5) | 0.08 |
| Seventh Layer: Protective Layer | |
| Gelatin | 1.33 |
| Acryl Modified Copolymer of Polyvinyl Alcohol (modification degree: 17%) | 0.17 |
| Liquid Paraffin | 0.03 |

(ExY) Yellow Coupler

-continued

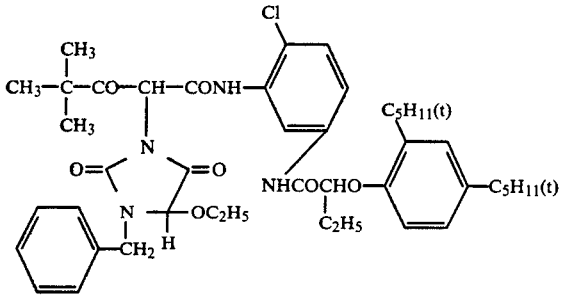

(ExM) Magenta Coupler

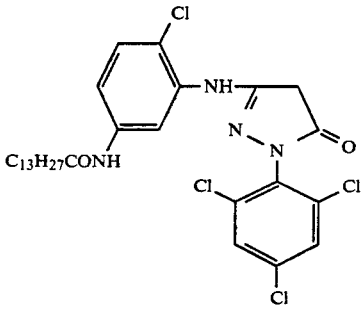

(ExC) Cyan Coupler
A 1/3/6 (by weight) mixture of

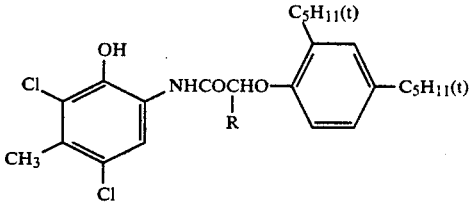

R = H, $C_2H_5$, $C_4H_9$ (Cpd-1) Color Image Stabilizer

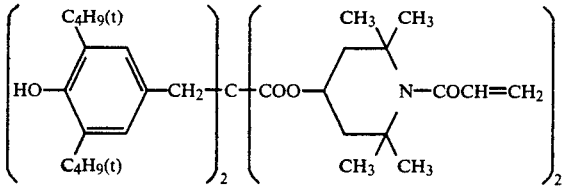

(Cpd-3) Color Image Stabilizer

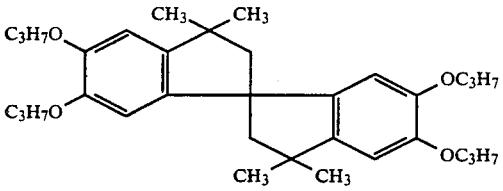

(Cpd-4) Color Image Stabilizer

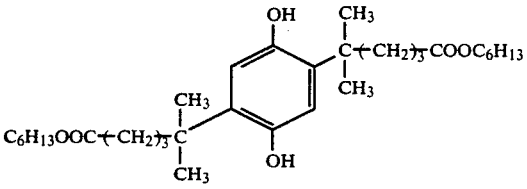

(Cpd-5) Color Mixing Preventing Agent

-continued

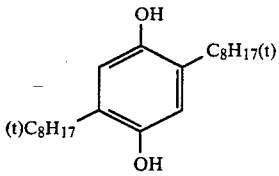

(Cpd-6) Color Image Stabilizer
A 2/4/4 (by weight) mixture of

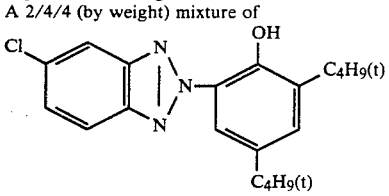

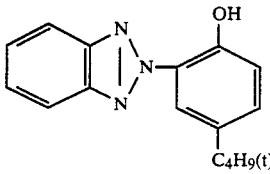

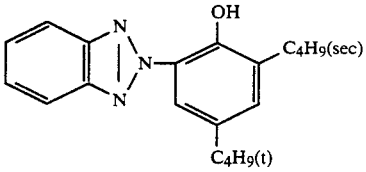

(Cpd-7) Color Image Stabilizer

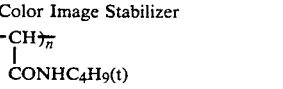

(average molecular weight: 60,000)

(UV-1) Ultraviolet Absorber
A 4/2/4 (by weight) mixture of

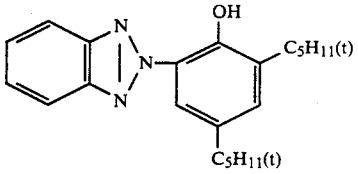

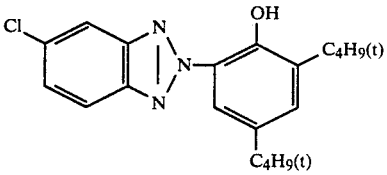

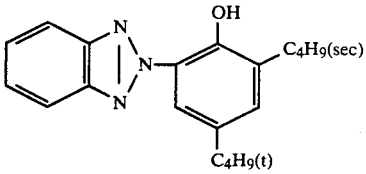

(Solv-1) Solvent

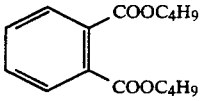

(Solv-2) Solvent
A 3/7 (by volume) mixture of

-continued

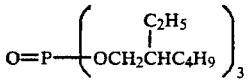

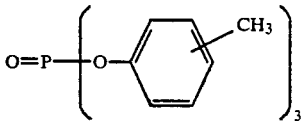

(Solv-3) Solvent
$O{=}P{-}[O{-}C_9H_{19}(iso)]_3$ (Solv-4) Solvent

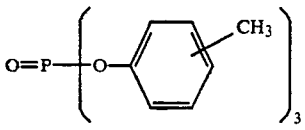

(Solv-5) Solvent
$COOC_8H_{17}$
|
$(CH_2)_8$
|
$COOC_8H_{17}$ (Solv-7) Solvent

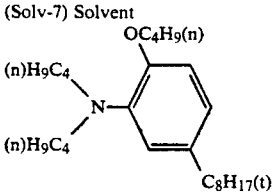

The thus obtained sample was referred to as Sample III-A. Samples III-B and III-C were prepared in the same manner as in Sample III-A except for changing the halide formulation of the silver halide emulsion as shown in the following table.

| Sample No. | Blue-Sensitive Layer (Cl %) | Green-Sensitive Layer (Cl %) | Red-Sensitive Layer (Cl %) |
|---|---|---|---|
| III-A | 99.0 | 99.0 | 98.4 |
| III-B | 95.0 | 95.2 | 95.2 |
| III-C | 72.3 | 71.8 | 71.8 |

The thus obtained samples were subjected to continuous processings (running test) according to the following processing steps.

| Processing Step | Temperature (° C.) | Time (sec) | Replenishing Amount* (ml) | Tank Volume (l) |
|---|---|---|---|---|
| Color Development | 40 | 45 | 75 | 10 |
| Bleach-Fixing | 30–36 | 45 | 218 | 10 |
| Washing (1) | 30–37 | 30 | — | 6 |
| Washing (2) | 30–37 | 30 | — | 6 |
| Washing (3) | 30–37 | 30 | 250 | 6 |
| Drying | 60–90 | 50 | — | — |

*Replenishing amount per $m^2$ of light-sensitive material (Washing was conducted in a three tank countercurrent system of Washing (3) to Washing (1))

As a processing machine, a roller transporting Fuji Color Sheet Processor FPSR 2030 (made by Fuji Photo Film Co. Ltd.) modified to adapt to the above described steps was used.

Formulation of each processsing solution is as follows.

| Color Developer: | Tank Solution | Replenisher |
|---|---|---|
| Water | 800 ml | 800 ml |
| Ethylenediamine-N,N,N',N'-tetramethylenephosphonic Acid | 3.0 g | 3.0 g |
| Triethanolamine | 8.0 g | 11.0 g |
| Potassium Chloride | 3.0 g | — |
| Potassium Bromide | 0.020 g | — |
| Potassium Carbonate | 25 g | 25 g |
| N-Ethyl-N-(β-methanesulfonamidoethyl)-3-methyl-4-aminoaniline Sulfate | 5.0 g | 7.0 g |
| Hydrazino-N,N-diacetic Acid | 5.0 g | 9.0 g |
| Fluorescent Brightening Agent (WHITEX-4, made by Sumitomo Chemical Co., Ltd.) | 1.25 g | 3.50 g |
| Water to make | 1,000 ml | 1,000 ml |
| pH (25° C.) | 10.05 | 10.80 |
| Bleach-Fixing Solution: | | |
| (tank soln. equals replenisher) | | |
| Water | 400 ml | |
| Ammonium Thiosulfate (70%) | 100 ml | |
| Ammonium Sulfite | 38 g | |
| Iron (III) Ammonium Ethylenediaminetetraacetate | 55 g | |
| Disodium Ethylenediaminetetraacetate | 5 g | |
| Glacial Acetic Acid | 9 g | |
| Water to make | 1,000 ml | |
| pH (25° C.) | 5.40 | |
| Washing Solution: | | |
| (The tank solution and the replenisher have the same formulation.) | | |

Ion Exchanged Water (content of calcium and magnesium: both not more than 3 ppm)

Additionally, the bleach-fixing solution was subjected to a running test in the following two manners with respect to each sample.

Processing 1

The overflow solution was not regenerated, and the aforementioned fresh replenisher was replenished, with the running test being conducted until the replenishing amount reached 10 times the volume of the tank.

Processing 2

The overflow solution was reused without desilvering, with merely adding the following regenerating agents every time 10 liters of the overflow solution was collected. This procedure was repeated 10 times and, at this point, the silver ion concentration in the bleach-fixing replenisher was analyzed according to an atomic light absorption method.

| Regenerating Agent | |
|---|---|
| (amounts to be added per liter of overflow solution) | |
| Ammonium Thiosulfate (70%) | 20 ml |
| Ammonium Sulfite | 15 g |
| Iron (II) Ammonium Ethylenediaminetetraacetate | 10 g |
| Disodium Ethylenediaminetetraacetate | 1.0 g |
| Glacial Acetic Acid | 20 g |
| Additionally, the pH of the replenisher was adjusted to 5.40. | |

The desilvering properties and color restoration properties were evaluated in the same manner as in Example 1. Separately, samples subjected to uniform exposure to impart a density of about 0.6 (gray samples) were prepared to evaluate density unevenness upon processing through visual evaluation. The results thus obtained are shown in Table 3.

TABLE 3

| Sample No. | Silver Amount (mol/liter) | Amount of Residual Silver ($\mu g/cm^2$) | Coloration Ratio (%) | Processing* Unevenness |
|---|---|---|---|---|
| | Condition 1 (i.e., Processing 1) | | | |
| III-A | 0 | 3 | 95 | B |
| III-B | 0 | 3 | 95 | B |
| III-C | 0 | 3 | 94 | M |
| | Condition 2 (i.e., Processing 2) | | | |
| III-A | 0.10 | 4 | 95 | G |
| III-B | 0.11 | 5 | 95 | G |
| III-C | 0.10 | 14 | 85 | M |

*G: not generated; M: slightly generated; B: generated

Data in accordance with the present invention are enclosed as [ ].

It is clearly seen from the results of Table 3 that Samples III-A and III-B using the silver chloride-rich emulsion (i.e., the high silver chloride emulsion) suffered processing unevenness in Processing 1, but did not suffer processing unevenness in Processing 2 using a replenisher containing silver ions, also showing good results as to desilvering properties and color restoration.

While the invention has been described in detail and with reference to specific embodiments thereof, it will be apparent to one skilled in the art that various changes and modifications can be made therein without departing from the spirit and scope thereof.

What is claimed is:

1. A process for processing a silver halide color photographic material, which comprises color developing and bleach-fixing said silver halide color photographic material, and then processing by at least one of washing said material with water and stabilizing said material, said silver halide color photographic material comprising a support having thereon at least one emulsion layer comprising a high silver chloride emulsion having a silver chloride content of 80 mol % or more and a used bleach-fixing solution which has been already used for said bleach-fixing, having a silver ion concentration of 0.02 mol/liter or more being used as a bleach-fixing solution for replenishment, wherein the silver halide is coated at a silver amount of 0.4 to 0.8 $g/m^2$ of the silver halide photographic material.

2. The process as in claim 1, wherein said silver halide color photographic material contains at least one yellow coupler represented by formula (I):

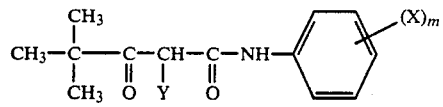

(I)

wherein X represents a substituent, Y represents a releasing group represented by

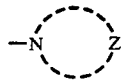

wherein Z represents a heterocyclic ring, and m represents an integer of 1 to 5.

3. The process as in claim 1, wherein said high silver chloride emulsion has a silver chloride content of 95 mol % or more.

4. The process as in claim 1, wherein said used bleach-fixing solution has a silver ion concentration of 0.02 to 0.4 mol/liter.

5. The process as in claim 2, wherein X represents at least one group selected from the group consisting of a halogen atom, an alkoxy group, a $-NHCOR_1$ group, a $-NHSO_2-R_1$ group, a $-SO_2NHR_1$ group, a $-COOR_1$ group, and a

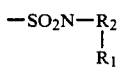

group, wherein $R_1$ and $R_2$ each represent a substituted or unsubstituted alkyl group.

6. The process as in claim 1, wherein said used bleach-fixing solution is not subjected to the removal of silver ion.

7. The process as in claim 1, wherein said silver ion concentration is 0.04 to 0.3 mol/liter.

8. The process as in claim 1, wherein said silver halide color photographic material is bleach-fixed immediately after color development.

9. The process as in claim 1, wherein said bleach-fixing solution for replenishment contains a regenerating agent.

10. The process as in claim 1, wherein said silver halide color photographic material is bleach-fixed at a bleach-fixing time of 10 to 60 seconds.

* * * * *